US005633668A

United States Patent [19]

Schwiebert et al.

[11] Patent Number: 5,633,668

[45] Date of Patent: *May 27, 1997

[54] PAPER PRECONDITIONING HEATER FOR INK-JET PRINTER

[75] Inventors: William H. Schwiebert, Cardiff; Damon W. Broder, San Diego, both of Calif.

[73] Assignee: Hewlett-Packard Company, Palo Alto, Calif.

[ * ] Notice: The term of this patent shall not extend beyond the expiration date of Pat. No. 5,406,321.

[21] Appl. No.: 360,891

[22] Filed: Dec. 21, 1994

Related U.S. Application Data

[63] Continuation of Ser. No. 56,039, Apr. 30, 1993, Pat. No. 5,406,321.

[51] Int. Cl.[6] ..... B41J 2/01

[52] U.S. Cl. ..... 347/102; 219/216

[58] Field of Search ..... 347/102, 101; 219/216, 549, 528

[56] References Cited

U.S. PATENT DOCUMENTS

| | | | |
|---|---|---|---|
| 3,600,551 | 8/1971 | Flanagan | 219/216 |
| 4,445,025 | 4/1984 | Metz | 219/549 X |
| 4,755,849 | 7/1988 | Tarumi | 219/216 X |
| 4,797,537 | 1/1989 | Berthelius | 219/528 |
| 4,908,497 | 3/1990 | Hjortsberg | 219/549 X |
| 4,914,562 | 4/1990 | Abe | 347/102 X |
| 4,982,207 | 1/1991 | Tunmore et al. | 347/102 |
| 5,287,123 | 2/1994 | Medin | 347/102 |
| 5,389,958 | 2/1995 | Bui | 347/103 |
| 5,406,321 | 4/1995 | Schwiebert | 347/102 |

FOREIGN PATENT DOCUMENTS 0568272 11/1993 European Pat. Off. ..... B41J 2/17

OTHER PUBLICATIONS

European Search Report, Jan. 13, 1995, re Application EP94302957.

Patent Abstracts of Japan, vol. 13, No. 83 (M-802) (3431) Feb. 27, 1989.

Patent Abstracts of Japan, vol. 12, No. 171 (M-700) (3018) May 21, 1988.

*Primary Examiner*—Joseph W. Hartary

[57] ABSTRACT

An ink-jet printer having improved print quality and full color printing capability on plain paper media. To accommodate placement of both input and output media trays on the same side of the printer housing for operator convenience, a paper path with a direction reversal is employed. A paper preconditioning preheater with a curved surface and a multi-purpose paper path component accomplish the direction reversal. As the print medium is driven through the paper path, it contacts the preheater. The preheating dries and shrinks the paper to condition it for the printing operation. The preheater is a thin flexible film carrying heating elements, and is suspended in air, to provide extremely low thermal mass and eliminate the need for long warmup times. The preheater defines a first, hotter, preheating area adjacent the printing area, and a second, cooler, preheating area separated from the printing area by the first preheating area.

22 Claims, 20 Drawing Sheets

FIG. 6B
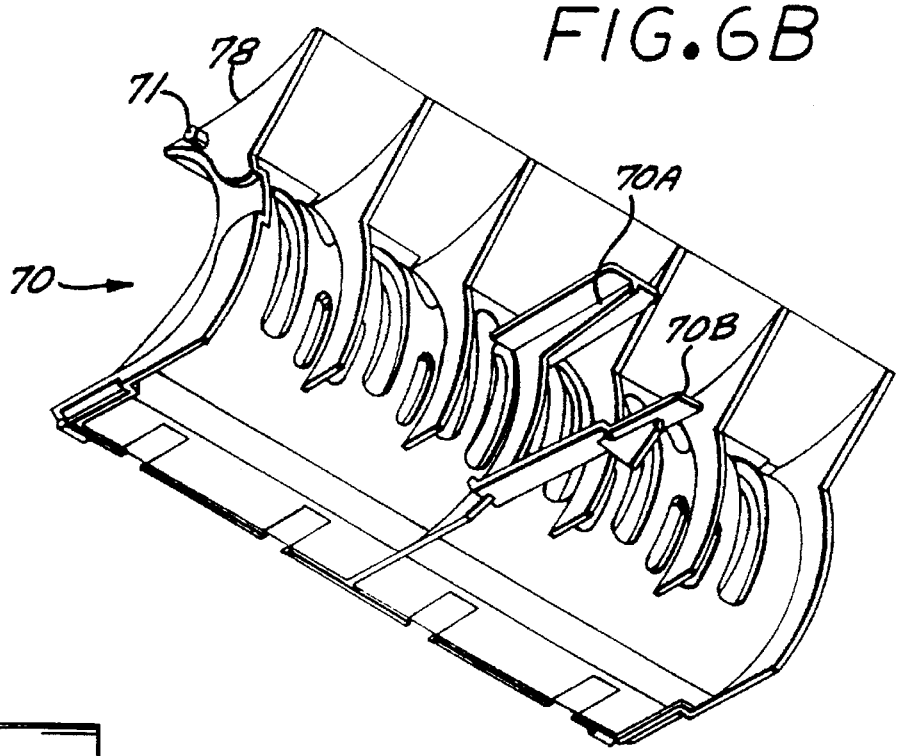
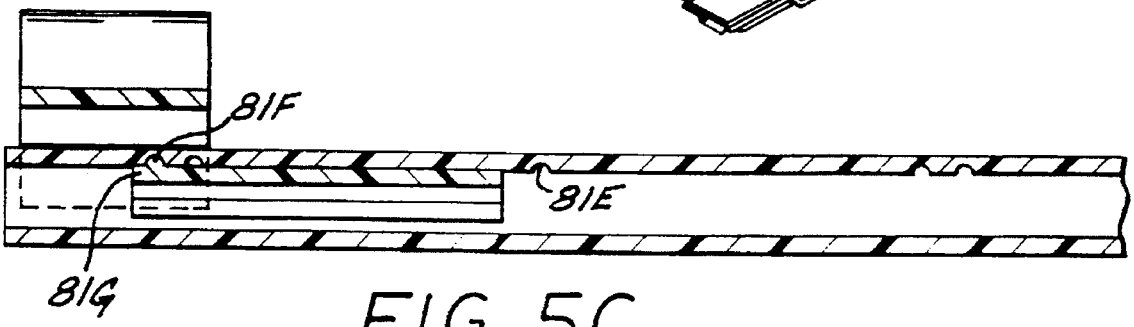
FIG. 5C
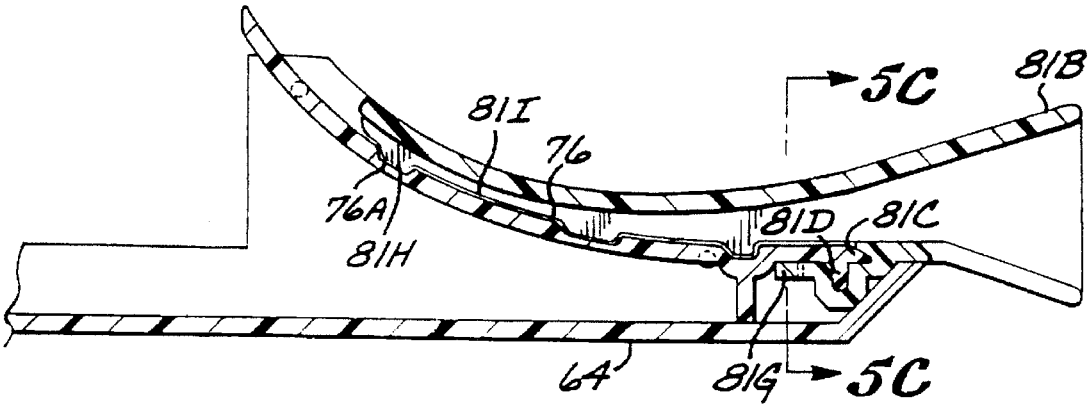
FIG. 5B

PAPER PRECONDITIONING HEATER FOR INK-JET PRINTER

CROSS REFERENCE TO RELATED APPLICATIONS

This is a continuation of application Ser. No. 08/056,039 filed on Apr. 30, 1993 U.S. Pat. No. 5,406,321.

RELATED APPLICATIONS

This application is related to application Ser. No. 08/056,287, filed, Apr. 30, 1994, PRINT AREA RADIANT HEATER FOR INK-JET PRINTER, by S. I. Moore et al.; application Ser. No. 08/056,288, filed Apr. 30, 1993, entitled AIRFLOW SYSTEM FOR INK-JET PRINTER, by W. Schwiebert et al.; application Ser. No. 08/056,229, filed Apr. 30, 1993, IMPROVED MEDIA CONTROL AT INK-JET PRINT ZONE, by R. R. Giles et al.; application Ser. No. 08/055,609, filed Apr. 30 1993, DUAL FEED PAPER PATH FOR INK-JET PRINTER, by R. R. Giles et al.; application Ser. No. 08/056,039, filed Apr. 30 1993, MULTI-PURPOSE PAPER PATH COMPONENT FOR INK-JET PRINTER, by G. G. Firl et al.; and application Ser. No. 07/878,186, filed May 1, 1992, PREHEAT ROLLER FOR THERMAL INK-JET PRINTER, by T. Medin et al.

BACKGROUND OF THE INVENTION

The present invention relates to the field of ink-jet printers.

With the advent of computers came the need for devices which could produce the results of computer generated work product in a printed form. Early devices used for this purpose were simple modifications of the then current electric typewriter technology. But these devices could not produce graphics or multicolored images, nor could they print as rapidly as was desired.

Numerous advances have been made in the field. The impact dot matrix printer is still widely used, but is not as fast or as durable as required in many applications, and cannot easily produce high definition color printouts. The development of the thermal ink-jet printer has solved many of these problems. Commonly assigned U.S. Pat. No. 4,728,963, issued to S. O. Rasmussen et al., describes an example of this type of printer technology.

Thermal ink-jet printers employ a plurality of resistor elements to expel droplets of ink through an associated plurality of nozzles. In particular, each resistor element, which is typically a pad of resistive material about 50 μm by 50 μm in size, is located in a chamber filled with ink supplied from an ink reservoir comprising an ink-jet cartridge. A nozzle plate, comprising a plurality of nozzles, or openings, with each nozzle associated with a resistor element, defines a part of the chamber. Upon the energizing of a particular resistor element, a droplet of ink is expelled by droplet vaporization through the nozzle toward the print medium, whether paper, fabric, or the like. The firing of ink droplets is typically under the control of a microprocessor, the signals of which are conveyed by electrical traces to the resistor elements.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column on the ink cartridge multiplied times the distance between nozzle centers. After each such completed movement or swath, the medium is moved forward the width of the swath, and the ink cartridge begins the next swath. By proper selection and timing of the signals, the desired print is obtained on the medium.

In order to obtain multicolored printing, a plurality of ink-jet cartridges, each having a chamber holding a different color of ink from the other cartridges, may be supported on the printhead.

Ink-jet printers must contend with two major drawbacks with two problems in printing high density text or images or plain paper. The first is that the ink-saturated media is transformed into an unacceptably wavy or cockled sheet; and the second problem is that adjacent colors tend to run or bleed into one another. The ink used in thermal ink-jet printing is of liquid base, typically a water base. When the liquid ink is deposited on wood-based papers, it absorbs into the cellulose fibers and causes the fibers to swell. As the cellulose fibers swell, they generate localized expansions, which, in turn, causes the paper to warp uncontrollably in these regions. This phenomenon is called paper cockle. This can cause a degradation of print quality due to uncontrolled pen-to-paper spacing, and can also cause the printed output to have a low quality appearance due to the wrinkled paper. Paper cockle can even cause the paper to contact the printhead during printing operations.

Hardware solutions to these problems have been attempted. Heating elements have been used to dry the ink rapidly after it is printed. But this has helped only to reduce smearing that occurs after printing. Prior art heating elements have not been effective to reduce the problems of ink migration that occur during printing and in the first few fractions of a second after printing.

Other types of printer technology have been developed to produce high definition print at high speed, but these are much more expensive to construct and to operate, and thus they are priced out of the range of most applications in which thermal ink-jet printers may be utilized.

The user who is unwilling to accept the poor quality must either print at a painfully slow speed or use a specially coated medium which costs substantially more than plain paper or plain medium. Under certain conditions, satisfactory print quality can be achieved at print resolutions on the order of 180 dots per inch. However, the problems such as ink bleeding are exacerbated by higher print solutions.

Using thermal transfer printer technology, good quality high density plots can be achieved at somewhat reduced speeds. Unfortunately, due to their complexity, these printers cost roughly two to three times as much as thermal ink-jet types. Another drawback of thermal transfer is inflexibility. Ink or dye is supplied on film which is thermally transferred to the print medium. Currently, one sheet of film is used for each print regardless of the density. This makes the cost per page unnecessarily high for lower density plots. The problem is compounded when multiple colors are used.

It is therefore an object of this invention to provide a color ink-jet printer which prints color images on plain paper with high quality, and which is simplified in its construction.

SUMMARY OF THE INVENTION

An ink-jet printer is described, and includes a printhead for printing onto a print medium. The printhead includes means for ejecting droplets of ink onto a first surface of the medium at a print area in a controlled fashion. Means are provided for advancing the print medium via a medium path to the print zone during print operations. A preconditioning preheater is disposed along the medium path for preheating the medium before it reaches the print area to precondition the medium for printing operations. In accordance with the invention, the preheater includes a thin heating surface, means for heating the surface, and means for supporting the surface along the medium surface so that the surface presents a curved surface which is contacted by the medium as it is advanced along the medium path to the print area.

In accordance with one aspect of the invention, the heating surface is defined by a thin flexible film having a large area suspended in air by a support structure. As a result, the preheater has very low thermal mass, and long warmup time intervals are avoided. The preheater may be fabricated at relatively low cost, and the power consumption requirements are reduced, since the preheater need not be powered at an idle state when no printing operations are underway.

The support structure includes means for securing one edge of the preheater film along the print area, curved edge support structures for supporting the edges of the film extending parallel to the medium advancement direction along an arc or curved path, and spring tensioners attached to corners of the film opposite the print area edge to hold the film taut, thereby requiring the film to assume the curve of the curved edge support structures, while suspending most of the area of the preheater in air.

In accordance with another aspect of the invention, the preheater has two heating areas, the first disposed adjacent the print zone, the second separated from the print zone by the first zone. The first zone generates more heat than the first zone.

In accordance with another aspect of the invention, the printer controller only activates the preheater to precondition paper media, and does not activate the preheater to precondition other types of media such as polyester-based media.

BRIEF DESCRIPTION OF THE DRAWING

These and other features and advantages of the present invention will become more apparent from the following detailed description of an exemplary embodiment thereof, as illustrated in the accompanying drawings, in which:

FIGS. 5B and 5C are cross-sectional views taken along respective lines 5B—5B and 5C—5C of FIG. 5A and FIG. 5B.

FIGS. 6A and 6B are isometric views of the unitary feed path component of the printer of FIG. 1.

DETAILED DESCRIPTION OF THE PREFERRED EMBODIMENT

Figure 1:
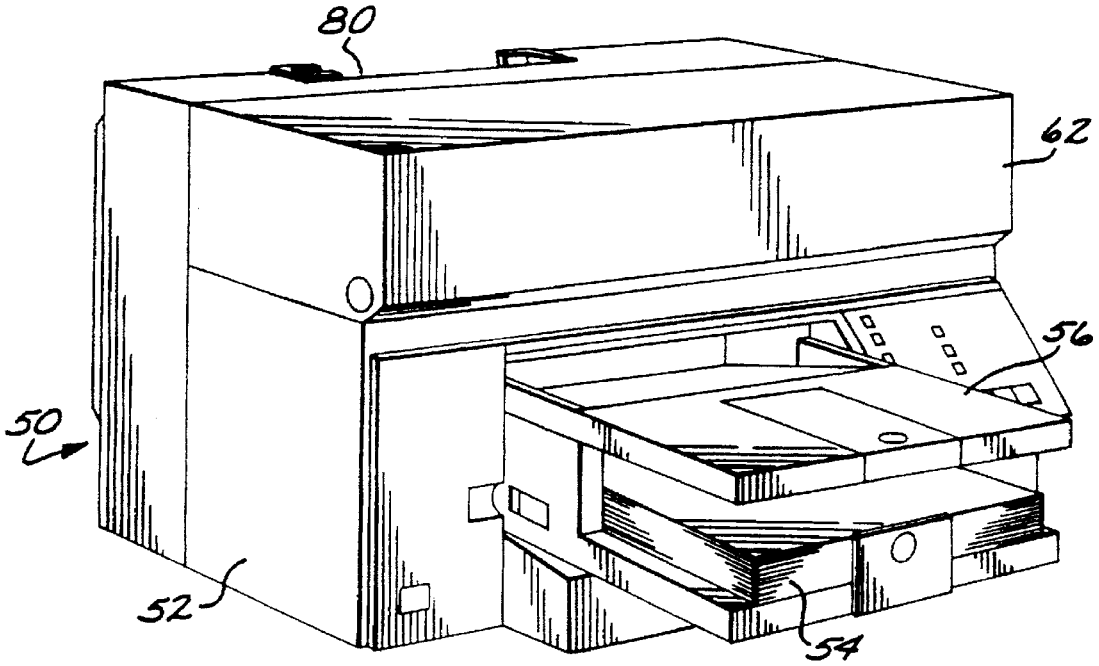
FIG. 1 is an isometric view of a color printer embodying the present invention, showing the front of the printer.
Figure 2:
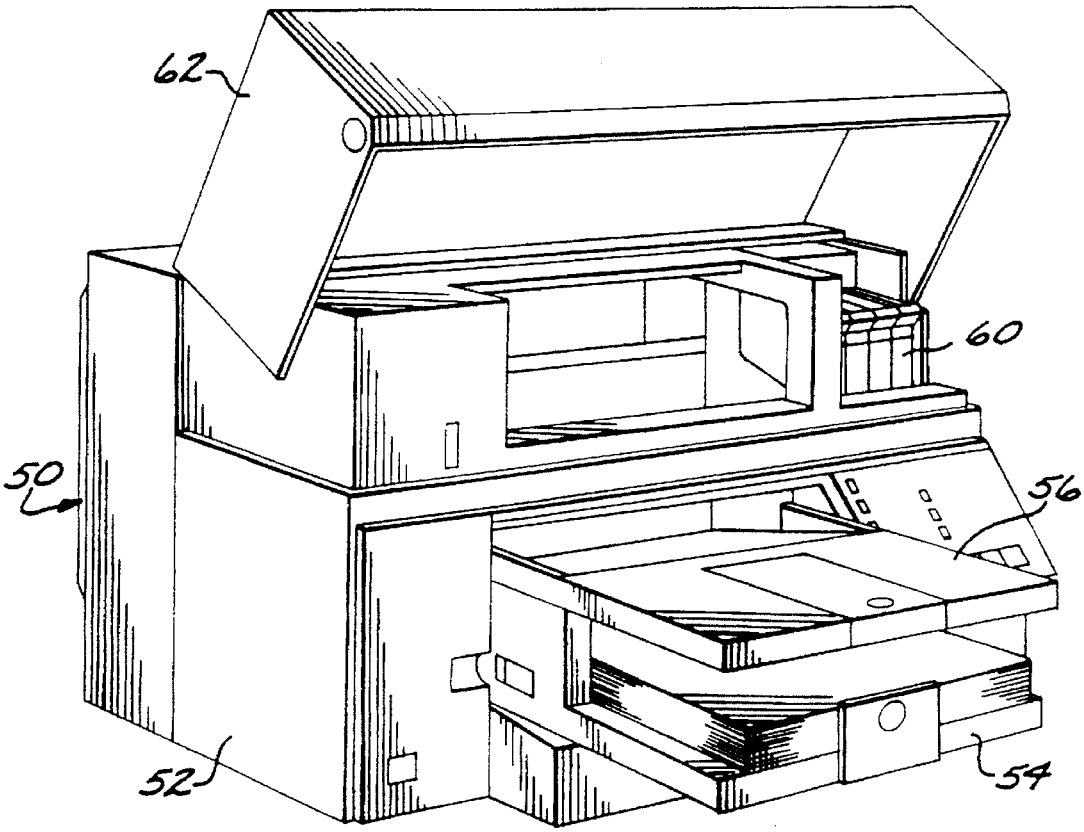
FIG. 2 is another isometric view of the color printer of FIG. 1, showing the top front cover in an open position.
Figure 3:
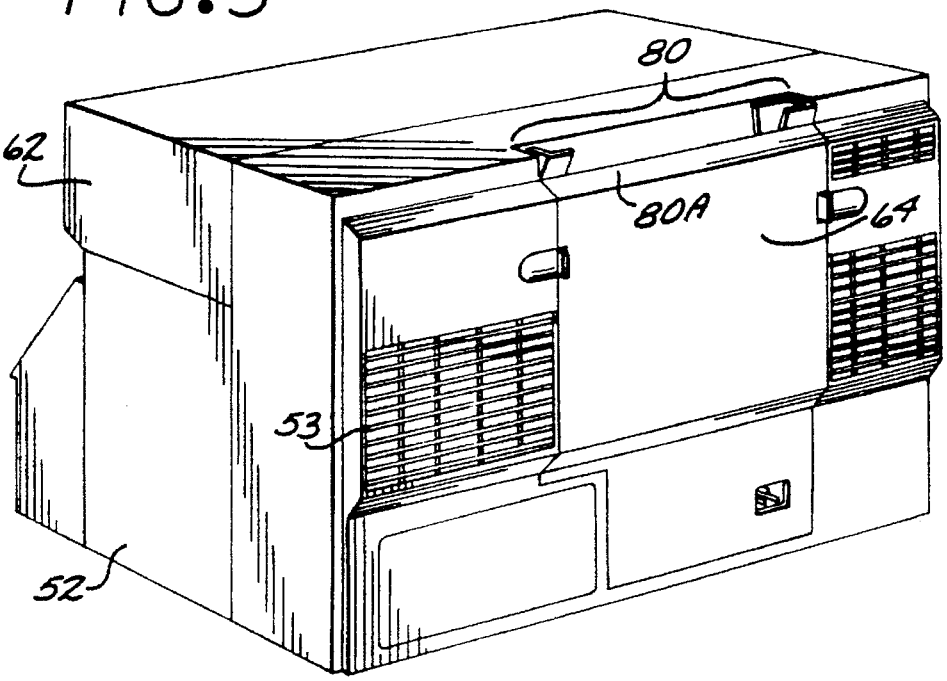
FIG. 3 is an isometric view showing the rear and side of the printer of FIG. 1.

External features of a color printer 50 embodying the invention is shown in the isometric views of FIGS. 1–3. The printer 50 comprises a housing 50 supporting an input media tray 54 and an output tray 56. The print media, e.g., sheet paper, is stacked in the input tray 54, and withdrawn by a pick mechanism, as is well known in the art. While it is to be understood that other types of print media may be used in the printer 50, for the sake of description herein the medium will be described as paper. The paper is driven through a paper path, to be described in more detail below, which reverses the direction of the paper and leads to the output tray 56. The paper is preheated by a preheater element which defines a portion of the medium path. The preheater drives moisture out of the paper and elevates the paper temperature, thereby conditioning the paper for the ink-jet printing which occurs at the printer print zone. The paper drive mechanism drives the paper through the print area, which has a print area heater for heating the paper to dry the ink very rapidly once the ink contacts the paper. An airflow system is provided to draw air past the print zone, clearing ink vapor and excess ink droplets away from the print zone. The airflow system includes ductwork which also draws air past electronic components to provide cooling, and to actively ventilate the heaters to prevent runaway temperature conditions.

This exemplary embodiment includes four ink cartridges 60 mounted on a carriage which is driven along a carriage axis extending orthogonally to the direction of paper travel past the print zone. The cartridges are visible in FIG. 2, in which the front top cover 62 of the printer is shown in an open position. In a typical application, the cartridges each contain ink of a different color, e.g., black, cyan, magenta and yellow, permitting full color printing operations. The inks are water-based in this exemplary embodiment.

Figure 4:
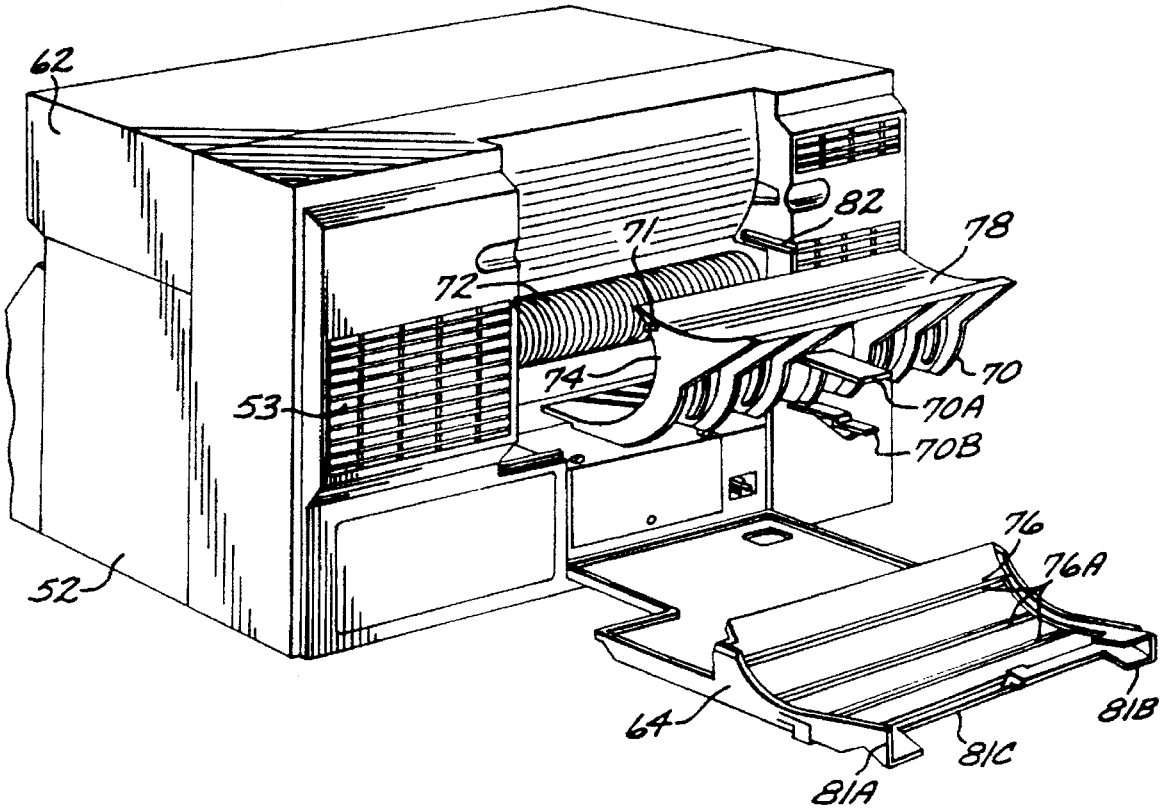
FIG. 4 is an isometric view similar to FIG. 3, but with the rear cover opened to show the feed path plug component.

The housing 52 for the printer 50 further includes a rear cover door 64 which may be opened to provide access to the rear of the printer, as shown in FIG. 4. In this embodiment, the door 64 is hinged at the bottom rear part of the housing. The paper path is defined in part by a multi-purpose paper path component 70 and the preheater element 72. The component 70 has a curved rib-defined contour 74 which defines a primary media path for the paper as it is picked from the input tray, guiding the paper through a direction reversal. The component 70 is easily removable, and includes pins 71 which slide into respective slots 82 defined by rails molded into the housing 52. The preheater 72 is also fixed in the printer so as to present a curved surface generally matching the curved contour 74 of the component 70, but spaced by a small separation distance from the component 70 surface, thereby defining a slot 94 comprising the paper path.

The cover door 64 includes a curved surface 76 which cooperates with a second curved surface 78 of the component 70, to provide a single sheet, top feed paper path, permitting the printer user to manually load paper, one sheet at a time, through a top rear loading slot 80. Paper entered via the single sheet feed slot 80 defined between an edge of the cover 64 and an edge of the housing 52 is guided by the curved surface 76 of the cover door 64 to the curved surface 78 of the member 70. In this manner, paper fed through the single sheet feed slot 80 is passed directly to a converging location 95 with the primary paper feed path.

Figure 5A:
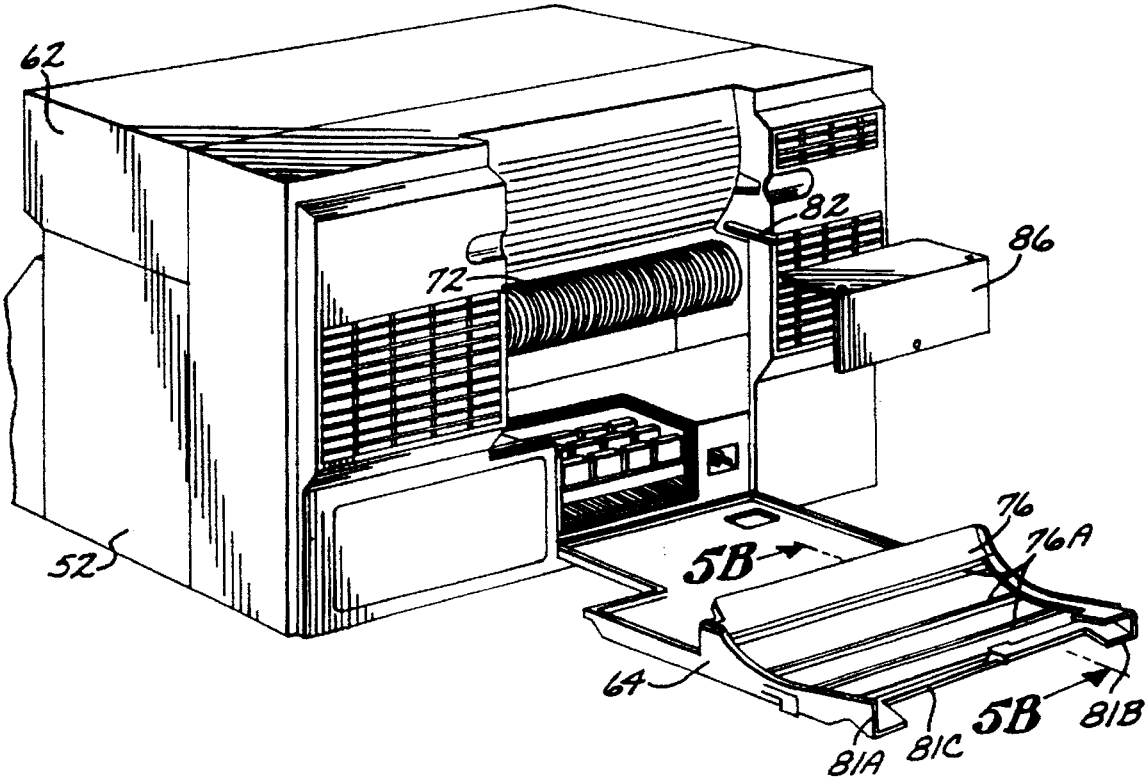
FIG. 5A is an isometric view similar to FIG. 4, but showing the lower housing cover removed to provide access to electronic memory elements.

The cover door 64 carries an adjustable slot-defining mechanism, as shown in FIGS. 3–5. The mechanism includes a fixed first media edge guide 81A, which is a slot side member molded as an integral part of the cover door 64. The adjusting mechanism further includes a sliding second media edge guide 81B which is a second slot side member defining a U-shaped configuration at the slot 80 input. The member 81B slides over edge 81C of the cover door 64, so as to form a sliding engagement between the second media edge guide 81B and the door 64. The printer user adjusts the position of the second media edge guide for the width of the print medium to be manually loaded. In this embodiment, the slot 80 width is adjustable to accommodate media of various widths, from e.g., 8½ inches width to small envelope widths of 4 inches or smaller.

The sliding edge guide 81B is shown in further detail in the cross-sectional diagrams of FIGS. 5B and 5C. As shown in FIG. 5B, the guide 81B interlocks along edge 81C of surface member 76 with a rib 81D protruding from the member 76. Detent positions for the sliding edge guide 81B are defined depressions 81E which accept raised area 81F protruding from spring member 81G of the sliding edge guide 81B.

The sliding edge guide 81B and the surface member 76 further include interlocking features 76A and 81H which prevent misdirection of envelopes to the print area. The features 76A are grooves formed in the surface of member 76. Interlocking tabs 81H extending from the edge 81I of the sliding edge member fit into the grooves 76A. As a result of this interlocking of features, items such as envelopes fed into the manual feed slot 80 are prevented from being misdirected due to an edge of the envelope sliding between the sliding edge member and the surface 76.

The use of a removable component 70 permits ready access to the electronic circuit devices 84 mounted on a circuit board below a metal removable cover plate 86, as shown in FIG. 5. This ready access facilitates repair or upgrading, e.g., changing print fonts by replacing memory devices comprising the devices 84, without requiring major disassembly of the printer. The devices 84 can even be changed without the need for trained service personnel.

Figure 6A:
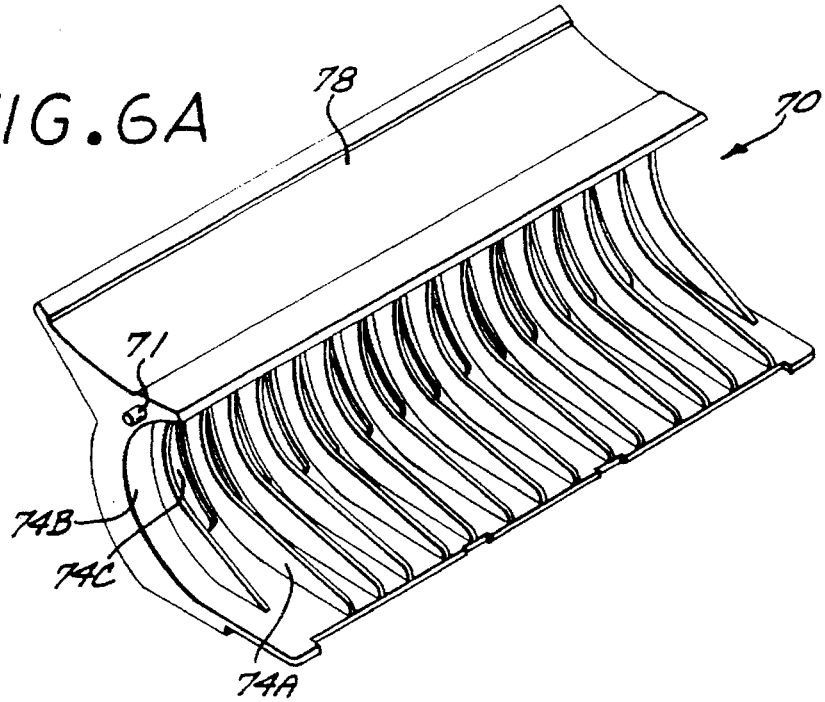

FIGS. 6A and 6B are isometric views of the paper path component 70. The curved contour 74 is defined by a number of aligned, spaced curved ribs 74A protruding from a curved surface 74B. Slot openings 74C are defined in the surface 74B between the ribs 74A.

The contour 74 of the component 70 defines a portion of the primary paper path which guides the paper from the input tray 54 to the print area. Both the input and output trays 54 and 56 are located at the front side of the printer for user convenience. As a result, the paper sheet which is to be printed must be re-directed on its journey between the input tray 54 and the output tray 56. The component 70 serves the function of defining a portion of that paper path within the printer.

The surface 78 of the component 70 also defines a portion of the manual-load paper path, which the user accesses through the slot 80 at the rear of the printer.

The print media will generate a static charge when rubbed on an insulating material such as plastic, from which the component 70 is molded. The use of the ribs 74A eliminates static buildup by minimizing the surface contact between the component 70 and the paper. The ribs further reduce the thermal mass of the component, and minimize heat conduction away from the paper.

Another advantage of the component 70 results from the slots 74C. Because tight clearances are required to move a sheet of paper, there is normally very little space inside the paper path. In a heated environment such as found in the printer 50, this could lead to water condensation from moisture driven off the paper during the preheating process, after migrating to cooler areas. The slots 74C permit an escape path for water vapor, thereby eliminating the condensation problem. At the same time, the component 70 still maintains the tight paper path geometry needed for moving the paper through the paper path.

Another advantage of the component 70 results from its easy removal from the printer. The user needs access to the paper path in order to clear paper jams that occur within the printer. The component 70 is easily removable, by grasping fingers 7A and 70B and pulling the component 70, providing access directly to the paper path so that the user can clear any jams easily.

The component 70 achieves these advantages as a one-piece element, performing several functions which have typically been performed in earlier printers using a multitude of parts, thus achieving a high order of functional integration. In a preferred embodiment, the component 70 is molded from an engineering plastic as a one-piece unit.

Figure 7:
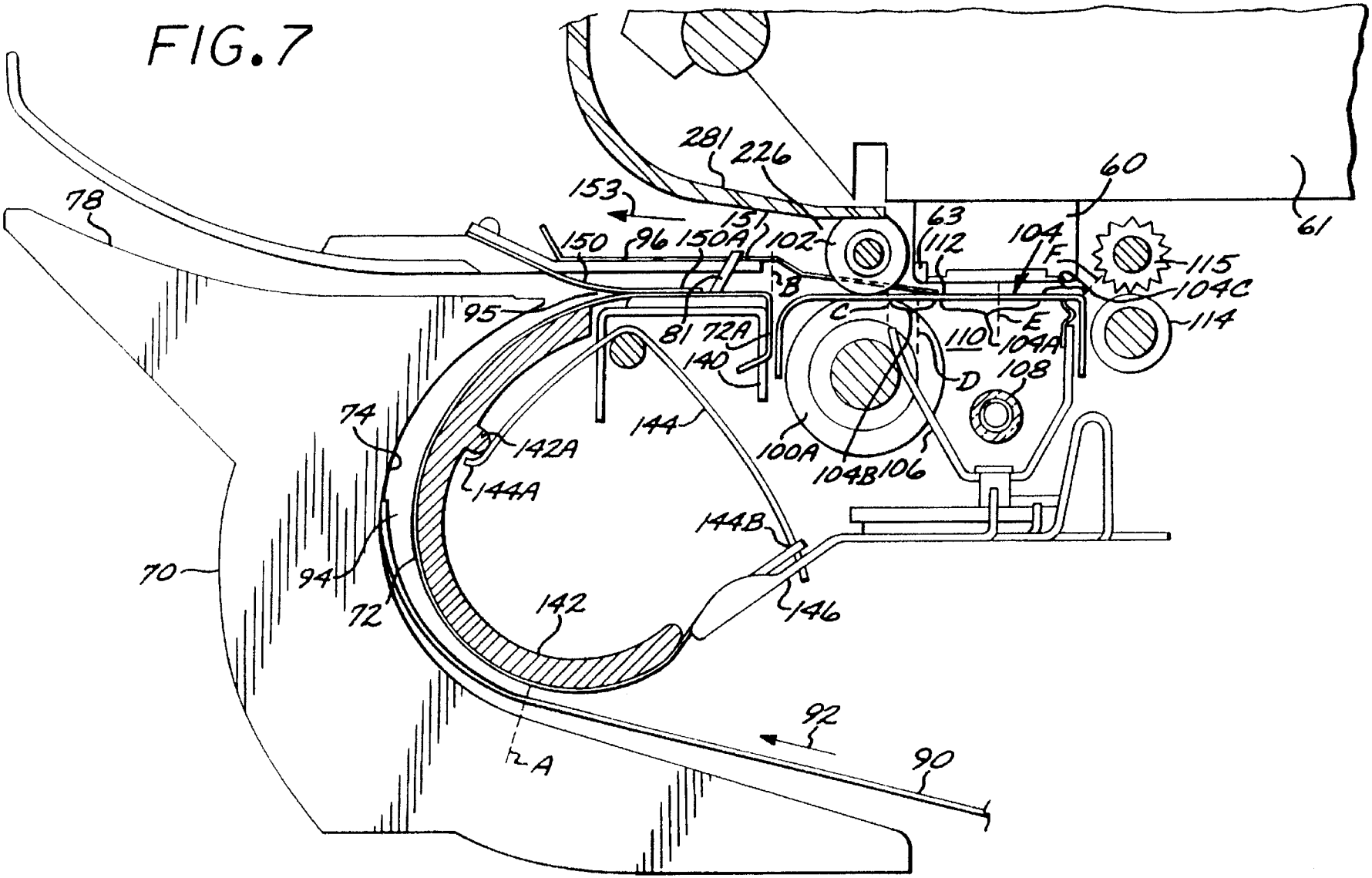
FIG. 7 is a cross-sectional view taken along a portion of the medium feed path of the printer of FIG. 1.

Referring now to FIG. 7, a major portion of the paper path through the printer 50 is illustrated in cross-section. The paper 90 is picked from the input tray 54 and driven into the paper path in the direction of arrow 92. The paper 90 enters the slot 94 defined by the curved surface 74 of member 70 and the preheater 72, contacts the curved contour 74 defined by the ribs 74A, and is guided around and in contact with the curved surface defined by the preheater 72. A guide 96 is secured above the outlet of the slot 94, and guides the paper to complete the reversal of direction, such that the paper is now headed 180 degrees from the direction its leading edge faced when picked from the input tray.

A flexible bias guide 150 is positioned above the upper guide 140 and preheater 72, so that one edge is in contact with the preheater 72, when no paper is present. The bias guide forces the paper against the preheater 72 to ensure effective thermal energy transfer. The leading edge of the preheated paper 90 is then fed into the nip between drive roller 100 and idler roller 102. With the paper being held against the heater screen 104 by a paper shim 151, the paper 90 is in turn driven past the print area 104, where radiant heat is directed on the undersurface of the paper by reflector 106 and heater element 108 disposed in the heater cavity 110 defined by the reflector. The screen 112 is fitted over the cavity 110, and supports the paper as it is passed through the print zone 104, while at the same time permitting radiant and convective heat transfer from the cavity 110 to the paper 90. The convective heat transfer is due to free convection resulting from hot air rising through the screen and cooler air dropping, and not to any fan forcing air through the heater cavity. Once the paper covers the screen during printing operations, the convection air movement is within the cavity.

At the print area, ink-jet printing onto the upper surface of the paper occurs by stopping the drive rollers, driving the cartridge carriage 61 along a swath, and operating the ink-jet cartridges 60 to print a desired swath along the paper surface. After printing on a particular swath area of the paper is completed, the drive rollers 100 and 114 are actuated, and the paper is driven forward by a swath length, and swath printing commences again. After the paper passes through the print area 114 it encounters output roller 114, which is driven at the same rate as the drive roller 100, and propels the paper into the output tray 56.

Figures 8, 9:
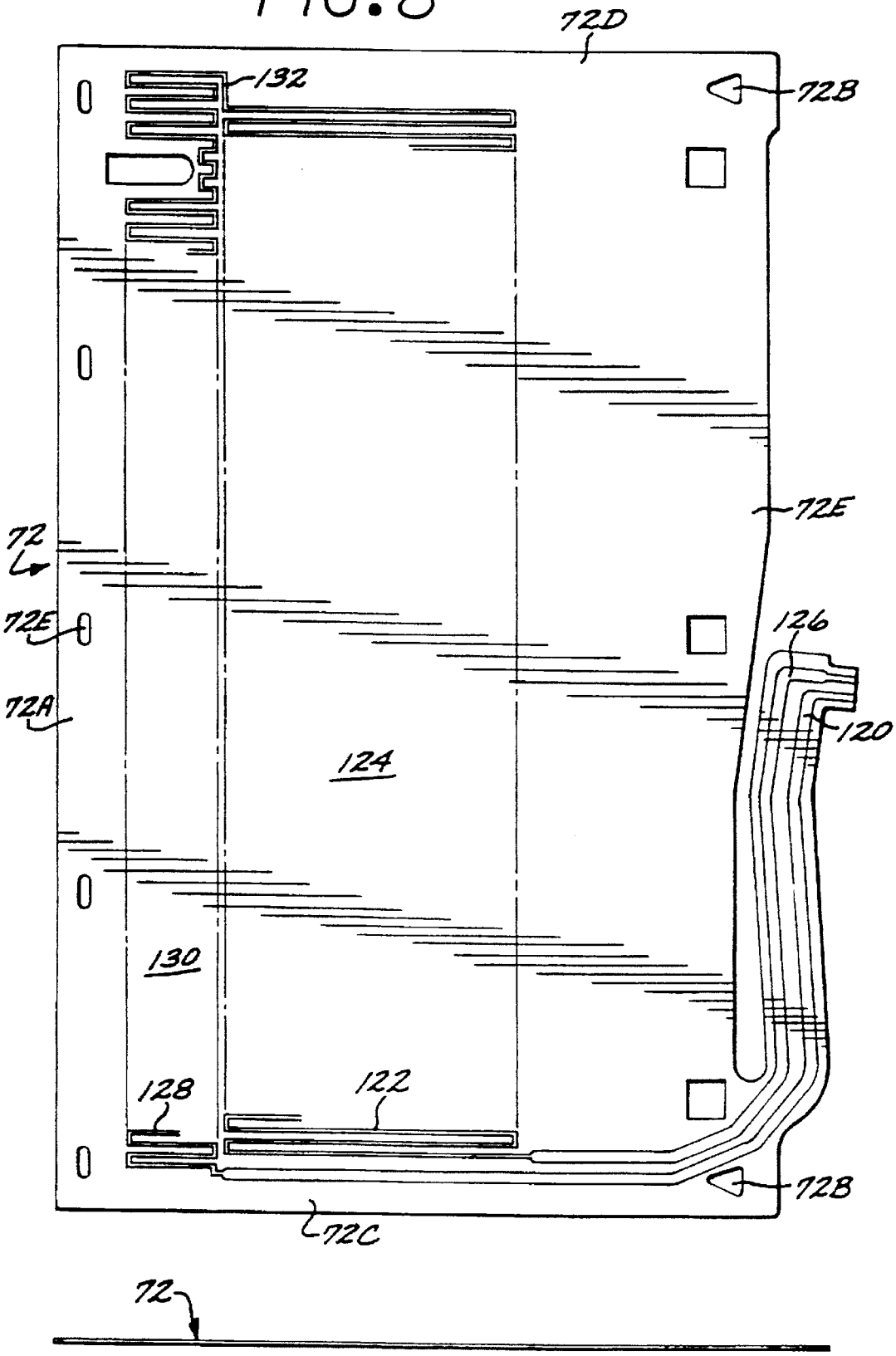
FIG. 8 is a top view of the flexible preheater element, in a flattened state.
FIG. 9 is a side view of the preheater element of FIG. 8, in the flattened state.

A feature of the printer 50 is the preheater 72, which comprises a flexible circuit member shown in FIG. 9 in a flattened configuration. The preheater 72 comprises a flexible dielectric member 72A, fabricated in this exemplary embodiment of polyamide. A conductive pattern of etched copper is defined on a surface of the dielectric member, and an anti-static layer of polyamide-based material covers the conductive pattern, forming a sandwich approximately 0.15 mm (0.006 inches) in thickness. The anti-static layer comprises a layer of polyamide impregnated with anti-static material such as copper, and is adhered to the copper pattern/polyamide base layer with an adhesive. One material suitable for the purpose of the anti-static outer layer is marketed as the "Kapton" polyamide film XC, by the E. I. DuPont de Nemoirs Company. This layer is sufficiently conductive to prevent charge buildup. The etched copper pattern defines relatively wide, low resistance traces which connect to relatively narrow, high resistive trace patterns causing heat to be generated when current is passed therethrough. In this preferred embodiment, there are two resistive patterns to provide different heat levels at two different areas of the preheater 72. Thus, low resistance conductor 120 connects to resistive, relatively narrow pattern 122 formed on the dielectric member 74A at area 124. Low resistance conductor 130 connects to resistive pattern 128 formed on the dielectric member at area 130. The two resistive patterns 122 and 128 are connected in series at 132. The respective conductors are connected to a electrical power source 204 (FIG. 19) which supplies current to drive the preheater 70. In this exemplary embodiment, area 130 dissipates 7.5 watts of electrical power, and area 124 dissipates 21 watts when the preheater 72 is activated. The traces are approximately the same density in both areas, but have larger trace width in area 130, the higher heat density area.

The preheater 70 is installed by attaching edge 72A of the preheater to the upper guide 140, wrapping it around features 142 molded into the printer chassis, and holding it taut by preheater springs 144. One end 144A of each spring bears against a protruding tab 142A of the feature 144, and the other spring end is inserted through an opening 72B formed in the preheater 72. The spring 144 biases the spring ends away from each other, thereby placing tensioning forces on the edges 72C and 72D of the preheater.

The preheater 70 is supported on edge 72A by the upper guide 140 and on edge 72E by the lower guide 146. The edge 72A is secured by fitting tabs 141 (FIG. 10) comprising guide 140 through slots 72E formed in the preheater film. The radius shape is accomplished by supporting only the edges 72C and 72D with the chassis features 142. The features 142 protrude from the side chassis by approximately 12 mm in this exemplary embodiment. Thus, the majority of the preheater surface is in free air to reduce to a minimum the thermal mass of the preheater and hence reduce the warmup time.

The purpose of the preheater 70 is to heat the paper so as to pre-shrink the paper to prevent it from shrinking in the print area 104. If the paper were to be allowed to shrink in the print area due to the heating caused by heating element 108, this would cause dot-to-dot placement errors and swath boundary errors. While the printer described in co-pending application Ser. No. 07/876,924, filed May 1, 1992, "Heater Blower System in a Color Ink-Jet Printer," by B. Richtsmeier et al., included a preheater in the form of a heated roller which advanced the paper from the paper tray to the print area, the heated roller has a relatively long warmup time due to the large thermal mass of the roller.

The preheater 72 has the advantage that, as a result of its low thermal mass, no additional warmup time is required to preheat the element 72, other than that required to feed the medium from the input tray. Moreover, the use of a flexible film for the preheater is very weight efficient.

Figure 10:
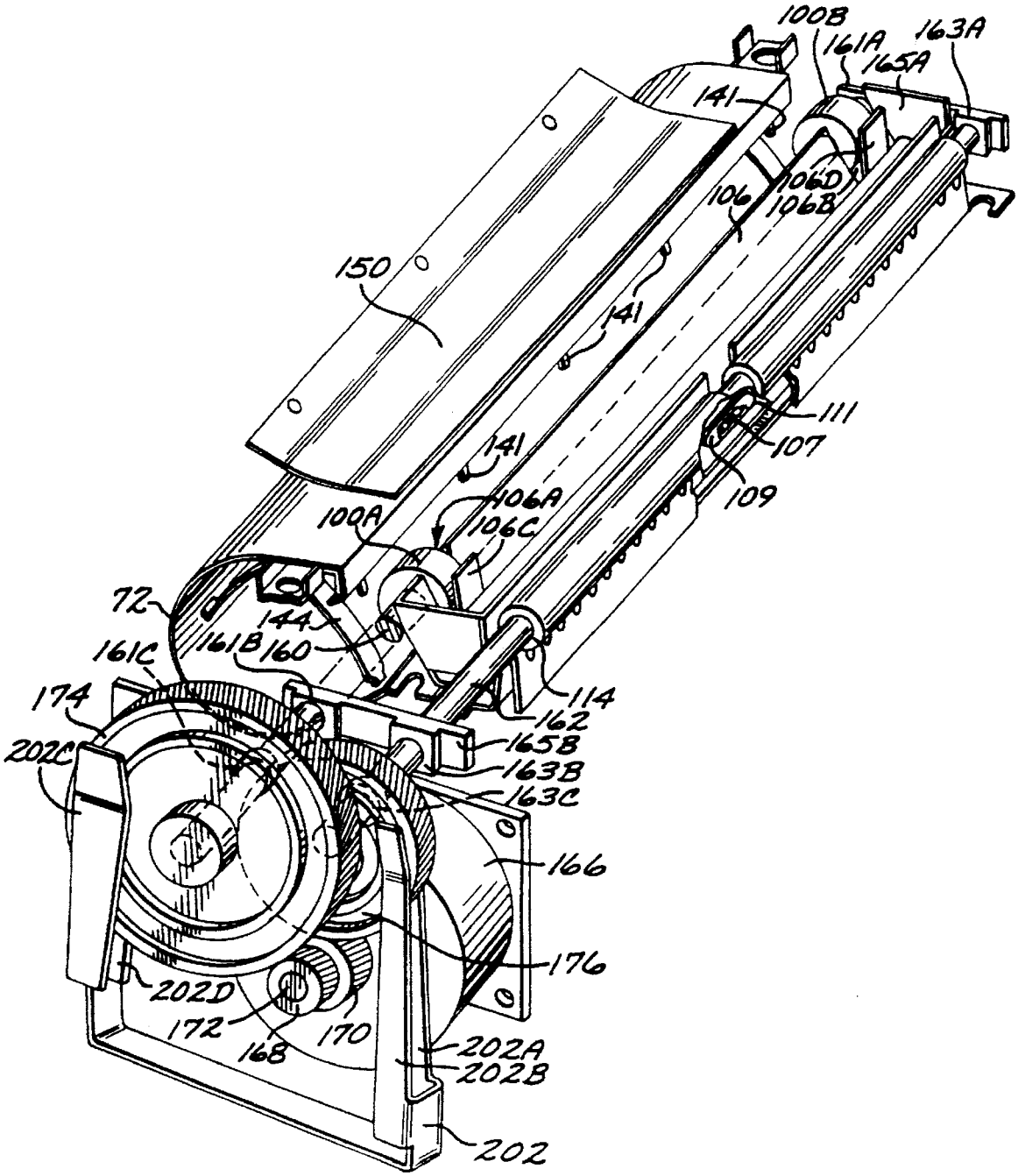
FIG. 10 is an isometric view of drive train elements comprising the medium drive system of the printer of FIG. 1.

FIG. 10 illustrates the arrangement of the paper drive and heating elements in an isometric view. For clarity, the screen 112 is not shown in this view. Drive rollers 100A and 100B are mounted for rotation on drive shaft 160. Tension roller 114 is mounted on tension shaft 162. Each shaft has a relatively small diameter, 0.250 inches in the exemplary embodiment. Such shafts, fabricated of stainless steel and with the relatively small diameter, are relatively non-rigid in this arrangement. In order to provide stability and the shaft stiffness required for accurate operation, each shaft is mounted on three bearings. Thus, shaft 160 is mounted on bearings 161A, 161B and 161C. Shaft 162 is mounted on bearings 163A, 163B and 163C. The bearings are secured on respective connector plates, e.g., 165A and 165B, so that the bearings self-align the relative positions of the shifter 160 and 162.

The rollers 100A and 100B in this exemplary embodiment are substantially larger in diameter than the drive shaft 160, e.g., 0.713 inches in diameter, and are fabricated of a heat-resistant, grit-covered material. With the rollers 100A and 100B larger than the diameter of the shaft 160, the effective heating area defined by the reflector opening can be maximized, since the rollers can be made to intrude into the cavity space at the edges of the cavity 110, but without reducing the area of the reflector opening between the rollers. Thus, in this embodiment, slots 106A and 106B are fashioned in the reflector 106 by cutting the reflector wall and bending the tabs 106C and 106D inwardly. The idler roller 102 has a similar configuration to driver roller 100, i.e., a small diameter shaft supporting two larger-diameter rollers. Idler starwheel 115 has a similar configuration to tension roller 114. As a result, the heating area provided by the heater assembly comprising the reflector 106 need not be sacrificed, while at the same time the handoff distance between the drive and tension rollers 100A, 100B and 114 can be kept small. Minimizing the paper handoff distance between the drive and tension rollers contributes to accuracy in paper advancement, since it minimizes the medium area over which the drive and tension rollers are not simultaneously acting. Moreover, no additional output rollers or mechanisms, other than the tension roller, are required to stack the media in the output tray 56.

Referring to FIG. 7, the area of the paper path between "A" and "B" is the preheated portion of the paper path. The area between "B" and "C" is an unheated portion of the paper path. The print zone 104A at which ink-jet printing by cartridges 60 occurs is centered at "E". The area 104B between "C" and "D" is heated by element 108, and represents an additional preheating zone adjacent the print zone at E. The area 104C between "E" and "F" is also heated by element 108, and is an area of post-print-heating of the medium.

In a preferred embodiment, the driver rollers 100A and 100B engage the paper adjacent opposed edges thereof. The rollers have a width dimension of 0.365 inches in this example, smaller than the margin width. The print area is forward of the drive rollers 100A and 100B, so that the drive rollers do not interfere with printing operations.

Figure 17:
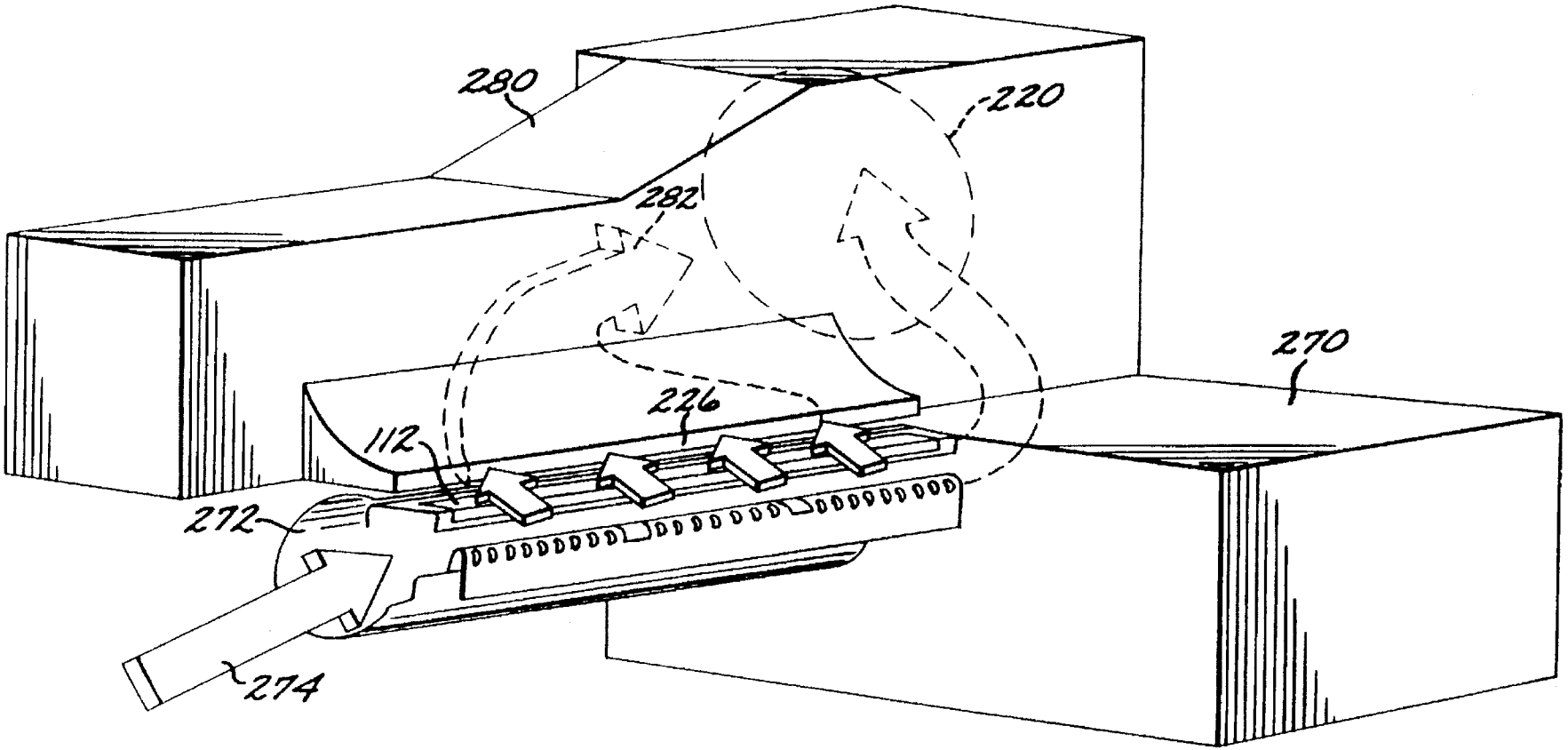
FIG. 17 is a partial isometric view, illustrating the right and upper chassis components, and the airflow path for vapor removal and heater ventilation.

Also shown in FIG. 7 are elements of the duct system comprising the printer 50 which define a duct inlet port 226 extending along the lateral extent of the print area, also shown in FIG. 17. The duct opening upper edge is defined by member 281, which in turn comprises the upper chassis member 280 (FIG. 17). The member 281 includes cutout regions (not shown) into which the upper areas of the idler rollers are accepted. The duct opening lower edge is defined by a thin shim member 151, which is connected to, and extends from, member 96. The shim 151 is fabricated of stainless steel, and extends between the drive rollers 100A and 100B. The shim 151 is biased into contact with the upper surface of screen 104 to a location underneath the adjacent edge of the print cartridges 60. The duct inlet 226 is therefore positioned immediately adjacent the cartridges 60 at the print area 104, e.g., within millimeters of the cartridges in this exemplary embodiment. The close positioning of the inlet duct opening 226 to the print area 104 is a factor permitting a single fan air flow system to be used in the printer 50. With such close positioning, by way of example, an air flow rate on the order of 100 cfm toward the inlet duct opening 226 can be obtained through an area at a printhead comprising the cartridges 60, as a result of an air flow rate at the duct inlet opening on the order of 300 cfm.

The paper drive mechanism of the printer 50 further comprises a motor 166 having two pinion gears 168 and 170 of different sizes mounted on the motor shaft 172. The pinion gears 168 and 170 directly drive the respective drive and tension shafts 160 and 162 through a drive gear 174 and a tension gear 176. The drive gear is slightly larger than the tension gear; the sizes of the pinion gears are selected with the sizes of the drive and tension gears to produce substantially equal drive and tension roller rotation speeds. All gears have helical gear teeth to minimize drive train noise. In this embodiment, the gears 174 and 176 are fabricated of an engineering plastic.

The motor 166 is mounted inboard of the shaft ends, to reduce the required width dimension along the carriage axis. The motor 166 in this exemplary embodiment is a permanent magnet stepping motor.

An anti-backlash device 202 is provided to prevent backlash movement of the gear train, thereby improving the accuracy and control of media advancement and positioning. The device 202 includes a first pair of spring fingers 202A and 202B, which lightly grip the gear 176 with sufficient grip force to prevent backlash movement, yet permit the gear 176 to be driven by the motor 166. The device 202 further includes fingers 202C and 202D which grip drive gear 174 in the same manner.

The foregoing features of paper path components of the printer 50 provide a number of advantages.

1. The fabrication cost of the printer is relatively low.
2. The printer is relatively compact while producing high print quality.
3. The shaft bearing system allows for use of compact, low inertia and low cost drive rollers.
4. The printer width is minimized by a compact drive gear and motor system.
5. The paper advance accuracy is high.
6. The printer allows for rapid paper advance and therefore good printing throughput.
7. An second output roller is not required to stack the media in the output tray.
8. The helical gears reduce the audible noise generated by the printer.

The heater element 108 comprises a transparent quartz tube 108A, open to the air at each end thereof, and a heater wire element 108B, driven by a low voltage supply. The wire element 108B generates radiant heat energy when electrical current is conducted by the wire, causing it to become heated, e.g., in the same fashion as an electric toaster generates heat. One type of wire material suitable for the purpose is marketed under the registered trademark "Kanthal." The heater 108 is a lower cost heater element than a halogen lamp used in the printer described in the above-referenced co-pending application Ser. No. 07/876,924.

The wire heater element 108 is powered from a 35 vDC signal from supply 202 (FIG. 19), which is modulated by a 31 KHz pulse width modulator to provide a square wave of variable pulse width, thereby allowing the various power settings necessary for operation of the heater 108. A thermistor 107 (FIG. 19) is used to sense the heater temperature. A constant power closed loop control circuit 204 comprising the pulse width modulator control functions, variable frequency control functions, and average current measurement and voltage measurement functions, controls the power applied to the heater element. A thermistor 107 sets the initial conditions for the heater warmup.

In response to an initial print command, the heater 108 in this exemplary embodiment is run at 110 W for a minimum of 26 seconds to ramp the heater up to operating temperature as quickly as possible. The heater power is then reduced to 73 W for plain paper printing, or to 63 W for printing on transparent polyester media, or to 28 W for glossy polyester media. Once the printer has finished the desired printing output and no other output is requested, the heater element 108 power is reduced to 20 W for a warm idle state.

Figure 11:
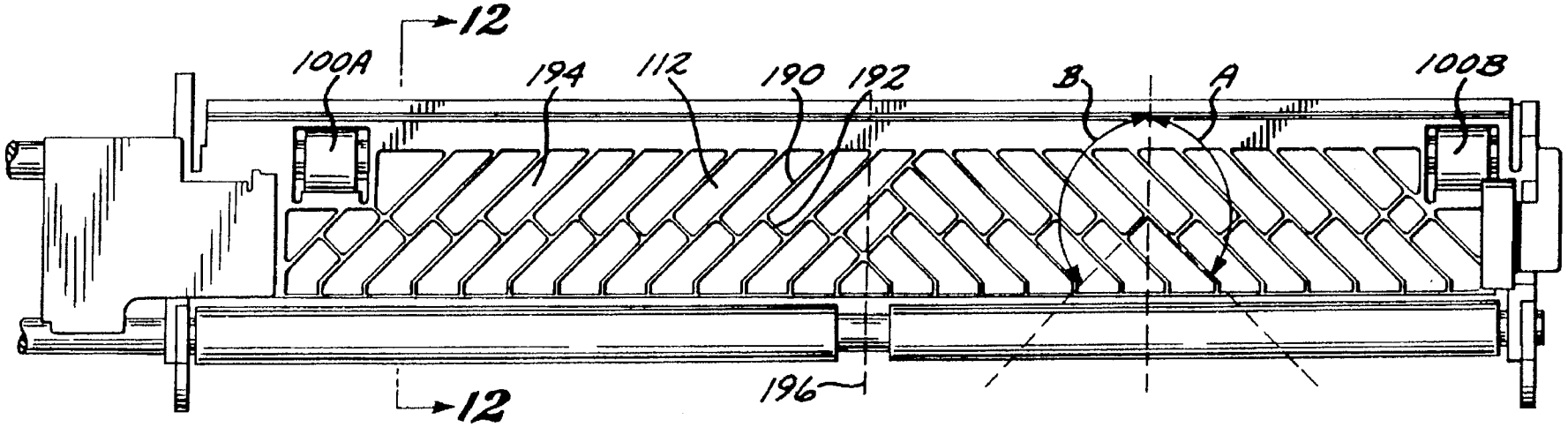
FIG. 11 is a top view of the print neater screen and drive rollers comprising the printer of FIG. 1.
Figure 12:
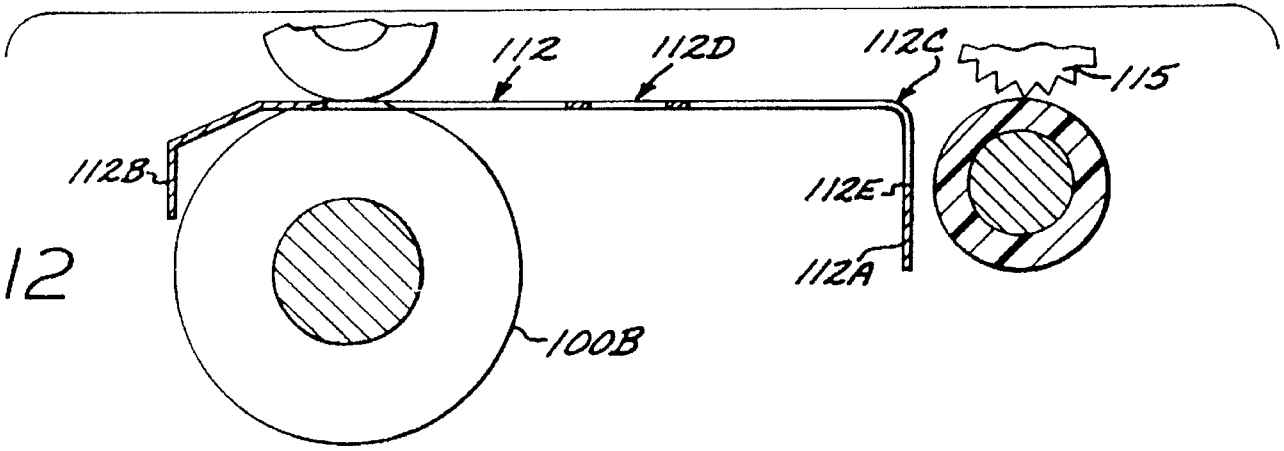
FIG. 12 is a cross-sectional view taken along line 12—12 of FIG. 11.
Figure 13:
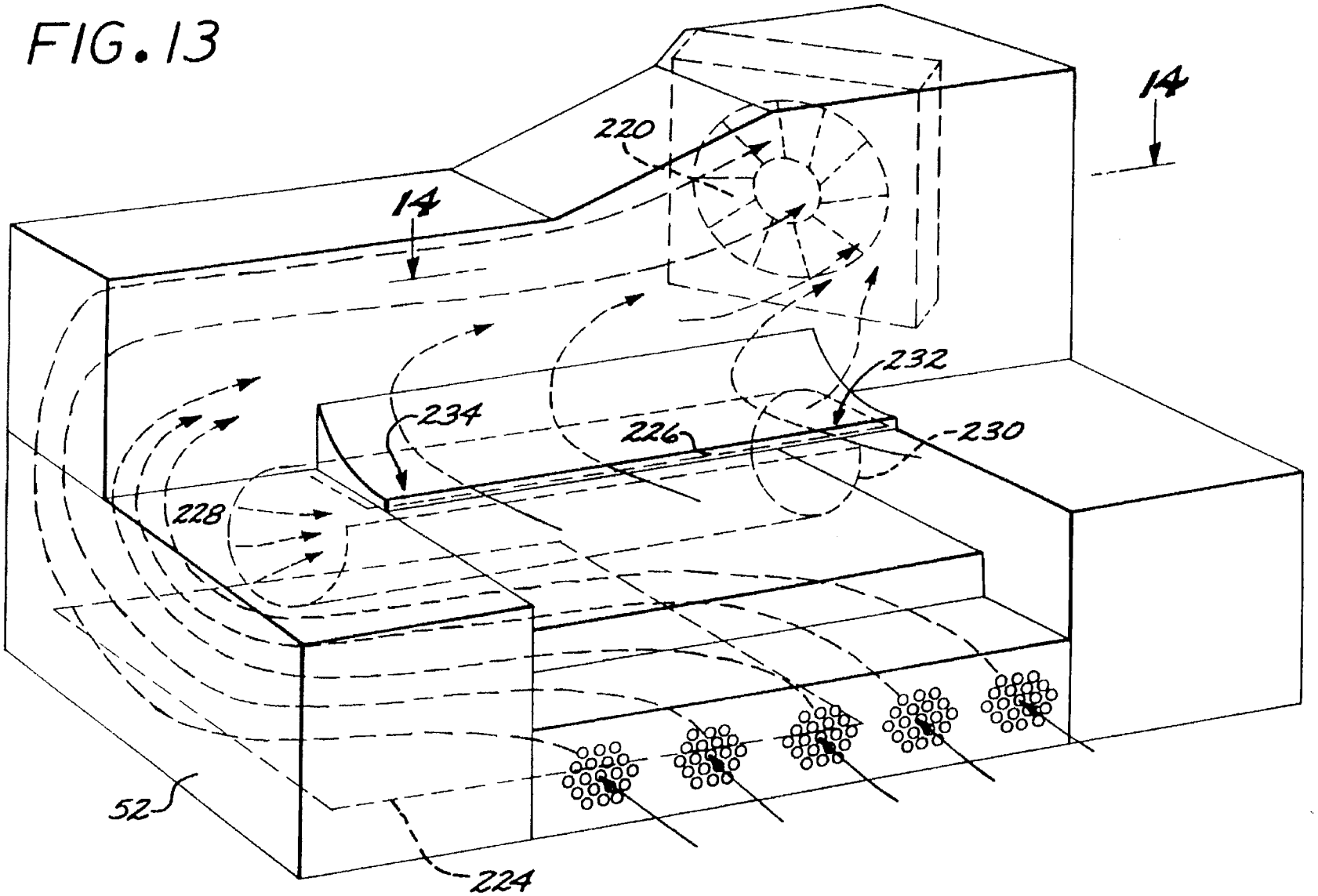
FIG. 13 is a simplified isometric schematic view showing the air-flow path within the printer of FIG. 1.

The print area screen 112 in this embodiment is further illustrated in FIGS. 11 and 12, and performs several functions. It supports the paper at the print area 104 and above the heater reflector 106. The screen is strong enough to prevent users from touching the heater element 108. The screen transmits radiative and convective heat energy to the print medium, while transmitting little if any conductive heat energy, which would cause print anomalies, due to nonuniform heat transfer. The screen 112 is designed such that the print medium does not catch a surface of the screen as it is driven through the print area.

The screen 112 performs these functions by the placement of a network of thin primary and secondary webs, nominally 0.032 inches (0.75 mm) in width, which outline relatively large screen openings. Exemplary ones of the primary and secondary webs are indicated as respective elements 190 and 192 in FIG. 11; exemplary screen openings are indicated as 194. The secondary webs 192 provide additional strength to the web network.

The screen 112 is preferably made from a high strength material such as stainless steel, in this embodiment about 0.010 inches in thickness. The openings 194 can be formed by die cutting or etching processes. The screen is processed to remove any burs which might catch the medium.

FIG. 12 shows a cross-sectional view of the one-piece member defining the screen 112, bent at one edge to define flange 112A, and bent at the other edge to define flange 112B. The web network is wrapped around the edge 112C such that it is defined not only on the horizontal surface 112D of the screen but also on the flange 112A, down to line 112E. This permits radiant heat to escape through the flange openings as well as the openings defined in the horizontal surface 112D, thereby expanding the post-printing heating area.

Typical dimensions for the screen include a screen opening pattern width (i.e., the dimension in the direction of medium travel) of 0.562 inches (14.28 mm), and opening 194 width and length dimensions of 0.194 inches (4.92 mm) and 0.777 inches (19.74 mm), respectively. The print area width (in the direction of medium travel) for the exemplary printhead comprising cartridge 60 of this embodiment is 0.340 inches (8.64 mm) covering the region subtended by each of the aligned printheads on the four print cartridges. The print cartridges are aligned in this embodiment; the cartridges could alternatively be staggered.

Referring again to FIG. 11, the screen grid pattern is essentially a mirror image about the center axis 196. Viewed from the edge at flange 112B of the screen 112 initially traversed by the print medium, the primary webs 190 are at a first obtuse angle A, in this exemplary embodiment, 135 degrees. The secondary webs 192 are at a second obtuse angle B relative to this edge which in this embodiment is 135 degrees. These angles are selected in order to provide a web network which has the requisite strength to prevent users from touching the heater element 108 and yet which permits the ready transfer of radiant and convective heat energy from the radiator cavity to the print medium.

The angle A of the primary webs 190 is determined by several factors. The web angles must first meet the requirement that the leading edge of the medium not catch on the webs as the medium is advanced. The web angles are also selected in dependence on the medium advance distance between adjacent print swaths. This distance is determined by the number of print nozzles and the print mode. In this exemplary embodiment, the printhead comprises two rows of 52 print nozzles each, spaced over a distance of 0.340 inches (8.64 mm). Thus, the total width of the area subtended by the printhead in this exemplary embodiment is 0.340 inches (8.64 mm). For a single pass mode the medium advance distance for each successive swath is 0.32 inches, i.e., the width of the area subtended by the print nozzle of a single one of the print cartridges. For a three pass mode, the distance is one-third the single pass distances, or 0.107 inches. For the six pass mode, the distance is 0.053 inches, i.e., one-sixth the medium advance distance for the single pass mode.

The width of the screen opening pattern is determined in the following manner for this exemplary printer embodiment. The opening pattern width can be considered to have three regions, the first region 104B between "C" and "D" in FIG. 7 a pre-heat region for preheating the advancing medium before reaching the active print zone. The second region 104A at E is the active print zone, i.e., the area subtended by the print nozzles comprising the printhead. In this embodiment, this area is defined by the nozzle coverage of the print cartridges. The third region 104C between "E" and "F" is a post-print heating region, reached by the medium after being advanced through the active print zone. In this embodiment, the pre-heat region width is equal to five three-pass medium advancement distances, or about 0.54 inches. The active print zone region centered at "E" has a width of 0.340 inches, as described above. The post-print heating region has a width equal to two three-pass mode increment distances, or 0.22 inches. The three regions aggregate approximately 1.1 inches in this embodiment.

The web angles are selected to as not to continuously shield the same area on the print medium from the radiant heat energy. The problem is evident if one considers the use of vertical webs, i.e., webs which are parallel to the direction of advancement of the medium, which obviously would not catch the medium as it is advanced. However, the same areas of the medium, those disposed over webs, will be shielded from the print cavity as the medium is advanced, and this area will dry differently than unshielded areas, showing the vertical web pattern.

By way of example, the preferred embodiment, with a primary web angle of 135 degrees, employs a vertical spacing distance D between adjacent primary webs 190 of approximately 8.13 mm (0.32 inches), wherein a three pass medium advance distance is 2.7 millimeters (0.107 inches).

FIGS. 13–18 illustrate the air duct and evacuation system comprising the printer 50. A single fan 220 is employed to draw air through various inlet openings into the duct system for evacuation outside the housing 52. One such group of inlet openings is defined in the front of the printer housing, below the input tray. These openings 222 (FIG. 16) admit air which is pulled past the electronic modules on circuit board 224 indicated generally in FIG. 13. Another inlet opening is elongated opening 226 disposed just above the print area 104, and extending along the lateral extent of the print area. Air, excess ink droplets and ink carrier vapor are drawn into the inlet opening, and away from the print area, by the action of the fan 220. Air is also drawn past the region of the motor 166, heater 108 and preheater 72, through housing openings 228 and 230 disposed on opposite ends of the heater element 108 and reflector 106.

Figure 14:
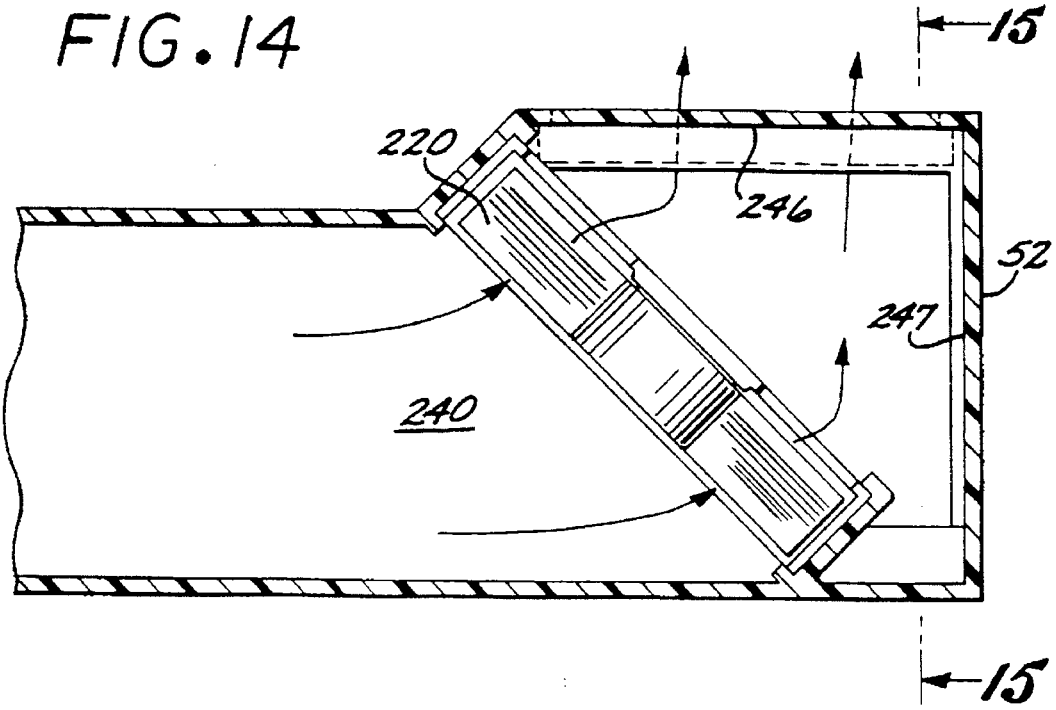
FIG. 14 is a cross-sectional view taken along line 14—14 of FIG. 13.
Figure 15:
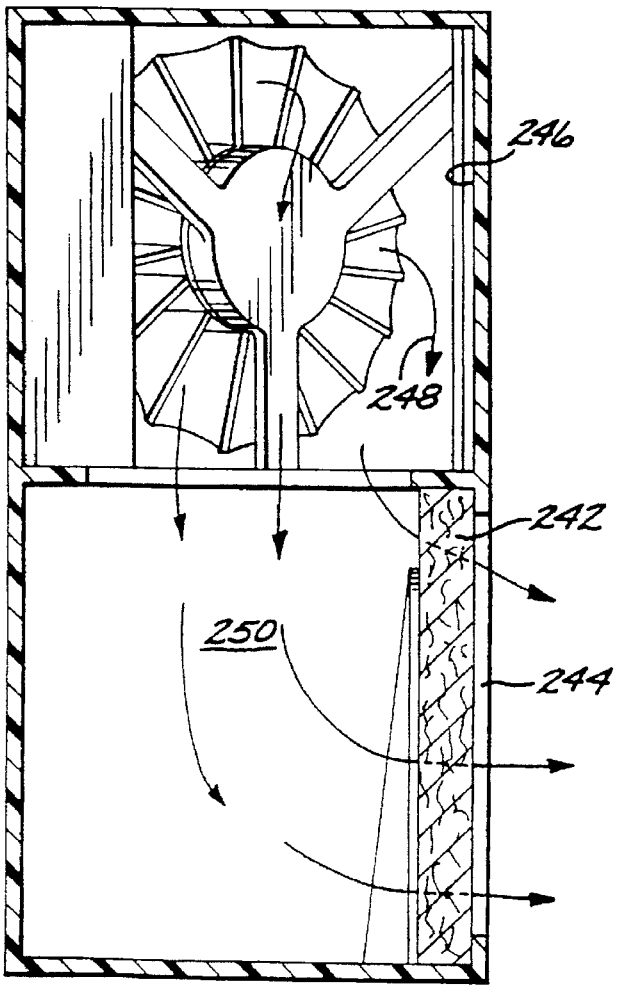
FIG. 15 is a cross-sectional view taken along line 15—15 of FIG. 14.

FIG. 14 is a cross-sectional view, showing the positioning of the fan 220 within the duct 240 comprising the printer 50. By positioning the fan on a diagonal offset relative to the duct opening, a larger fan is accommodated within the duct. FIG. 15 is a further cross-sectional view, illustrating the positioning of filter element 242, the fan 220 and the exhaust opening 244 formed in the ductwork. The exhaust opening 244 is placed at a level below the fan level in the printer housing. The flow of air from the fan 220, shown by arrows 248, essentially impacts against the wall 246 comprising the duct 240, and is deflected downwardly into a duct passageway 250 including wall 247 which leads to the filter element 242 and the duct exhaust opening 244.

Thus, a single fan is employed with a duct system defined within the housing 52 to comprise an airflow system which fulfills several functions, cooling the electronics packages comprising the printer 50, removing vapor and excess ink spray from the print region, and preventing runaway temperatures in the heater 108, preheater 72 and stepper motor 166 area. This airflow system produces an evenly distributed air flow across the printing area. The fan 220 is mounted to the side of the printing area, tending to cause a gradient across the printing area, in that the airflow adjacent edge 232 of the inlet opening 226 is higher than that adjacent edge 234. To balance the airflow across the opening 226, the volume of the duct at area 200A behind the portion of printing area adjacent the fan is enlarged, relative to the portion 280B of the printing area, and the electronics cooling airflow is passed through this duct behind the opening 226. This produces a relatively evenly distributed airflow into the opening 226 as long as the opening height dimension is kept sufficiently small, e.g., 0.25 inches in this exemplary embodiment.

The airflow system provides filtering functions. One function is to filter out as many ink droplets as possible before they are exhausted from the housing via a perforated area 53 (FIG. 3). Another function is to have the ink particles that do escape the printer housing be as dry as possible. These functions must be achieved with a minimum of airflow restrictions- Lengthening the air path and causing it to impinge onto two duct walls 246 and 247 helps to separate out and dry the ink particles.

A further benefit of mounting the fan 166 upstream from the exhaust opening from the housing 52 is that there is a reduction in acoustic noise.

Figure 16:
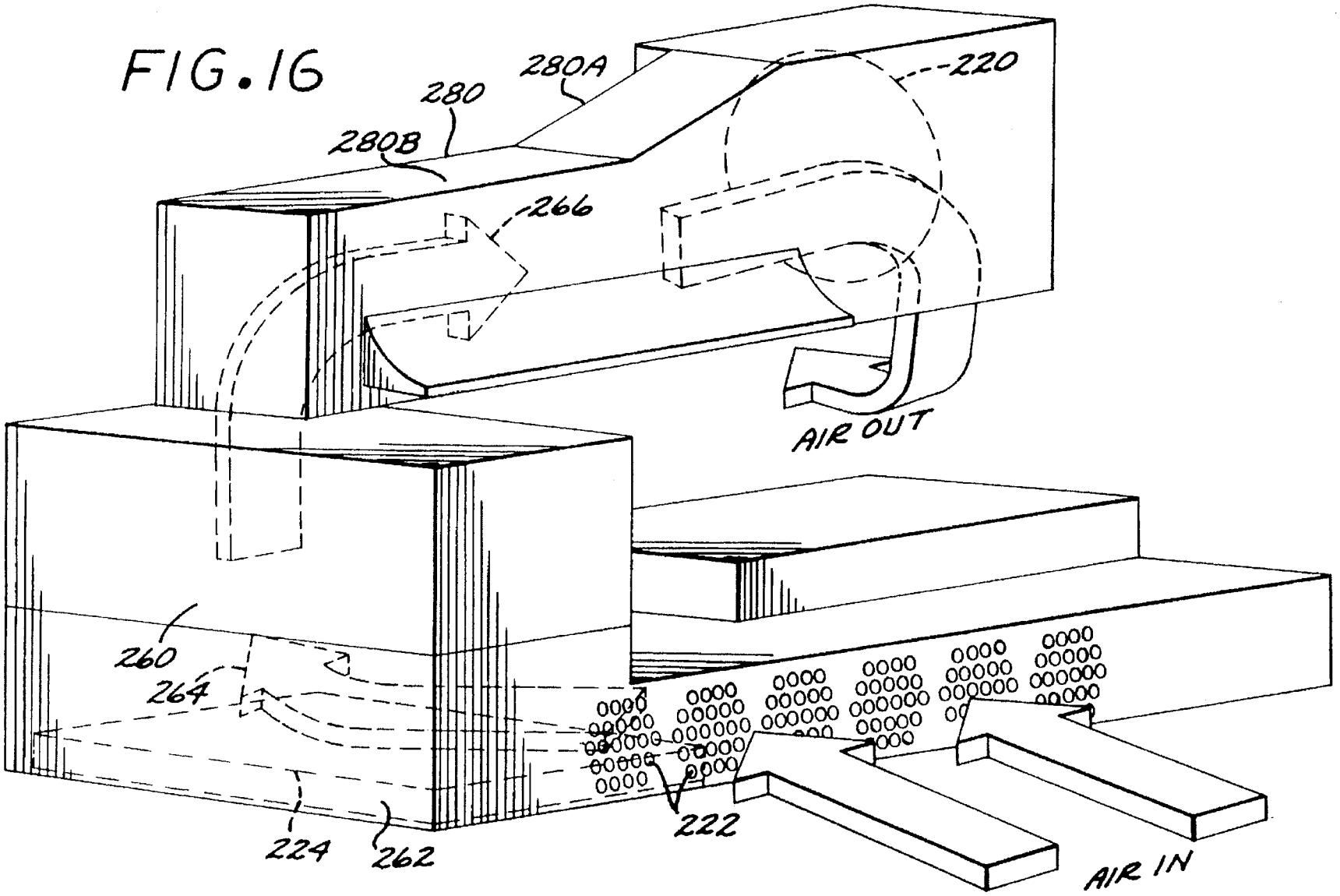
FIG. 16 is a partial isometric view of the printer of FIG. 1, illustrating the left and upper chassis components, and the airflow path for cooling the printer electronics.
Figure 18:
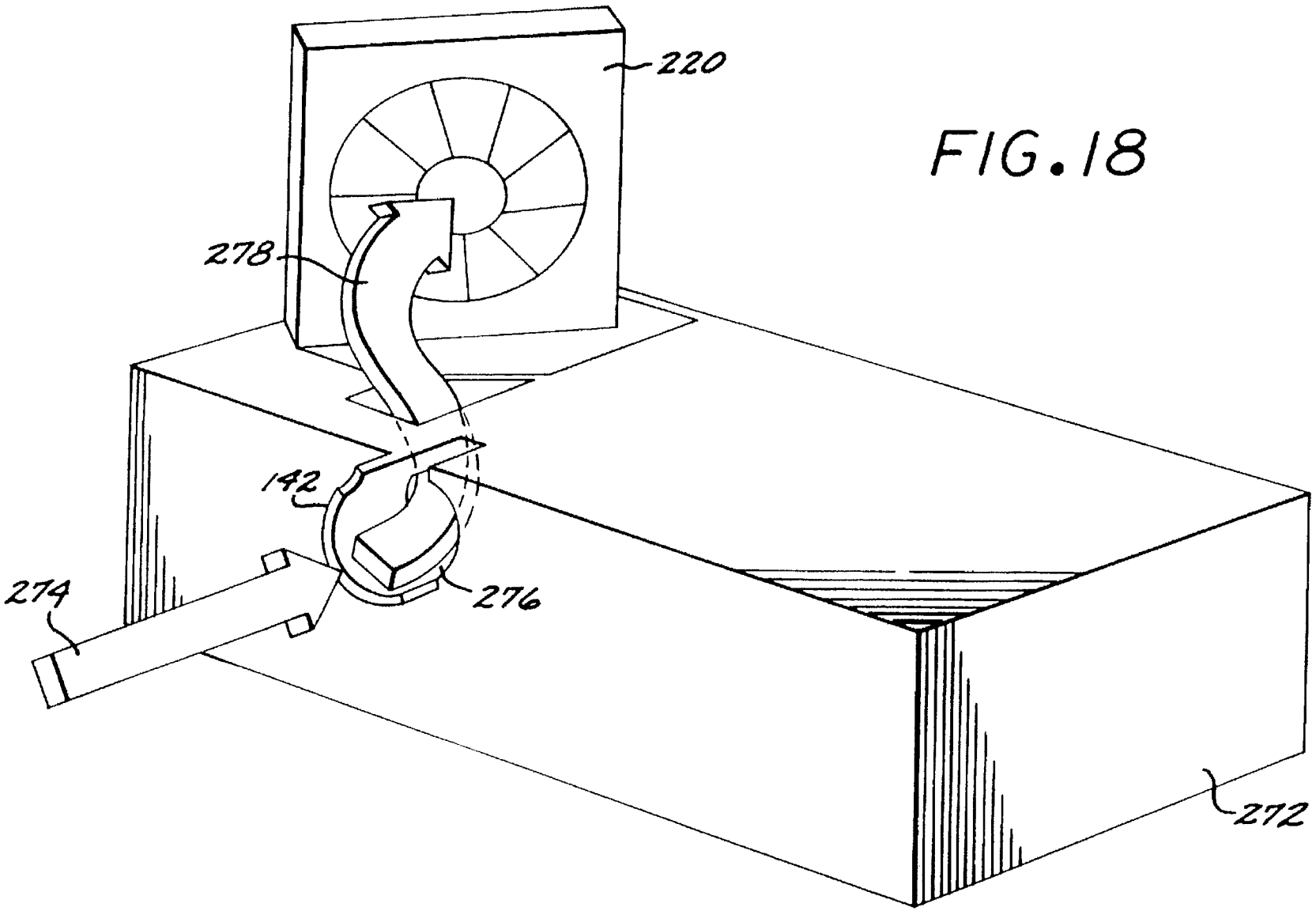
FIG. 18 is a partial isometric view illustrating the airflow out of the heater enclosure into the right chassis to the fan.

In a preferred implementation, the airflow system for the printer 50 comprises left, right and upper chassis assemblies 260, 270, 280, illustrated in FIGS. 16–18. In a preferred implementation, these chassis members are injection molded parts, fabricated from an engineering plastic. Each chassis member is molded to define duct enclosures which define air passageways through which air is drawn by the fan operation. FIG. 16 illustrates in simplified form the left chassis 260, mounted on lower chassis member 262 which encloses electronic components comprising the printer 50, and the upper chassis 280. As indicated by arrows 264, 266, the air flow resulting from the fan operation is through the inlet openings 222 formed in the lower chassis member 262, past the printer power supply 224 area, and up into the upper chassis 280 through communicating duct openings. The air flow continues through the fan 220, and then down to the lower level, exiting opening 53 through the filter element 242.

FIG. 17 illustrates the vapor removal and heater ventilation functions provided by the airflow system. Here, the right chassis 270 and upper chassis 280 are shown, with the left chassis 260 removed for clarity. Air is drawn into the duct defined by the upper chassis 280 through the elongated duct opening 226 adjacent the print area. This air flow is illustrated by arrow 282. Air indicated by arrow 274 is also drawn from an opening formed in the left chassis 260 through the space 272 defined by the preheater 72, the reflector 106 and the lower guide 146, and into an opening 276 formed in the right chassis 270. This airflow is shown more clearly in FIG. 18. The air flow through the right chassis continues up to the duct defined in the upper housing 280 and into the fan 220. FIG. 18 also illustrates an exemplary one of the side features 144 which supports an edge of the preheater 72.

Figure 19:
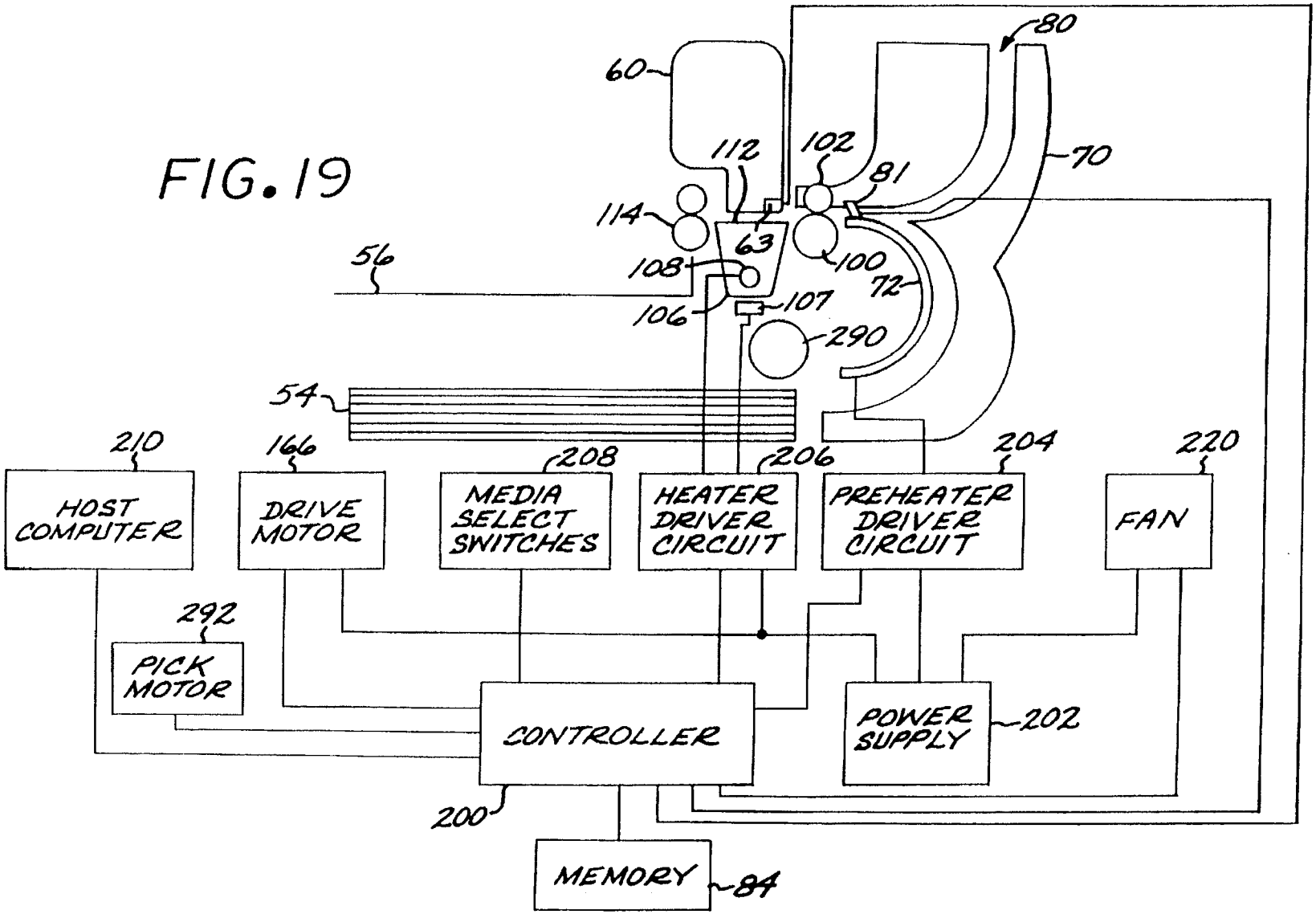
FIG. 19 is a schematic illustration of the printer paper path components and the control and drive elements therefore.

FIG. 19 is a schematic block diagram illustrating the control elements associated with the paper path through the printer 50. Illustrated here in a schematic form are the paper trays 54 and 56, the pick roller 290 which picks sheets from the input tray and delivers the sheet into the paper path between the preheater 72 and the component 70, and up into the nip between the drive roller 100 and the idler roller 102. The pick roller 290 is driven by pick motor 292. An exemplary ink-jet cartridge 60 is disposed above the print area. The heater element 108 with the reflector 106 is disposed below the print area. A temperature sensing resistor 107 is disposed on a circuit board 109 disposed adjacent an opening 111 (FIG. 10) in the bottom portion of the reflector 106, and senses the temperature within the reflector cavity 110.

The electronic components are shown in schematic form in FIG. 19 as well. A printer controller 200 interfaces with a host computer 210, such as a personal computer or work station, which provides print instructions and print data. The printer 50 further includes media select switches and other operator control switches 208, which provide a means for the operator to indicate the particular type of medium to be loaded into the printer, e.g., plain paper, glossy coated paper or transparencies. Alternatively, the host computer signals may specify the particular type of media for which the printer is to be set up. As described above, the heater element 108 is controlled by a constant power feedback circuit, wherein heater current sensing and voltage sensing is employed to set the heater element drive signals produced by the drive circuit 206 from DC power supplied by the printer power supply 202. The drive circuit 206 is in turn controlled by the controller 200. The preheater 72 is driven by the preheater driver circuit from 35 VDC power supplied by the power supply 202, and is also controlled in an open loop fashion by the controller 200. The operation of the fan 220 is controlled by the controller 200. The controller 200 accesses data stored in the memory devices 84 which may, for example, define fonts and other parameters of the printer.

The manual feed slot and path may be used in the following manner. With the printer 50 in a ready state, a single sheet or envelope is manually fed into the manual feed slot 80. A sensor 81 in the manual feed paper path is activated by the manually fed paper, and the drive roller 100 is started rotating as a result. The sheet or envelope is fed forward, and the leading edge is recognized by a carriage sensor 63. The carriage sensor signal is used by the controller 200 to finely position the paper relative to the print area, and to commence printing operations.

Figure 20A:
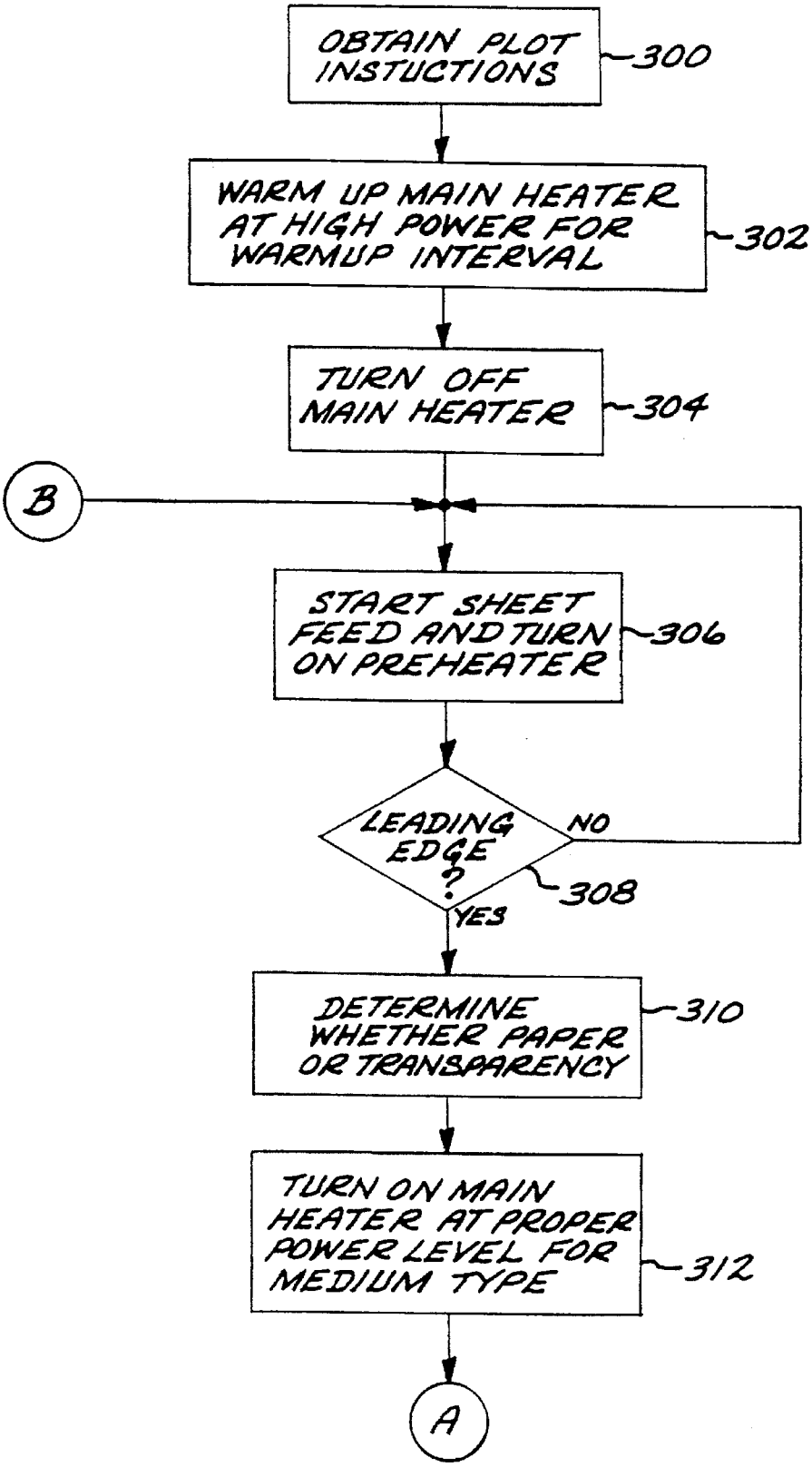
FIGS. 20A and 20B are flow diagrams illustrating the operation of the printer of FIGS. 1–19.
Figure 20B:
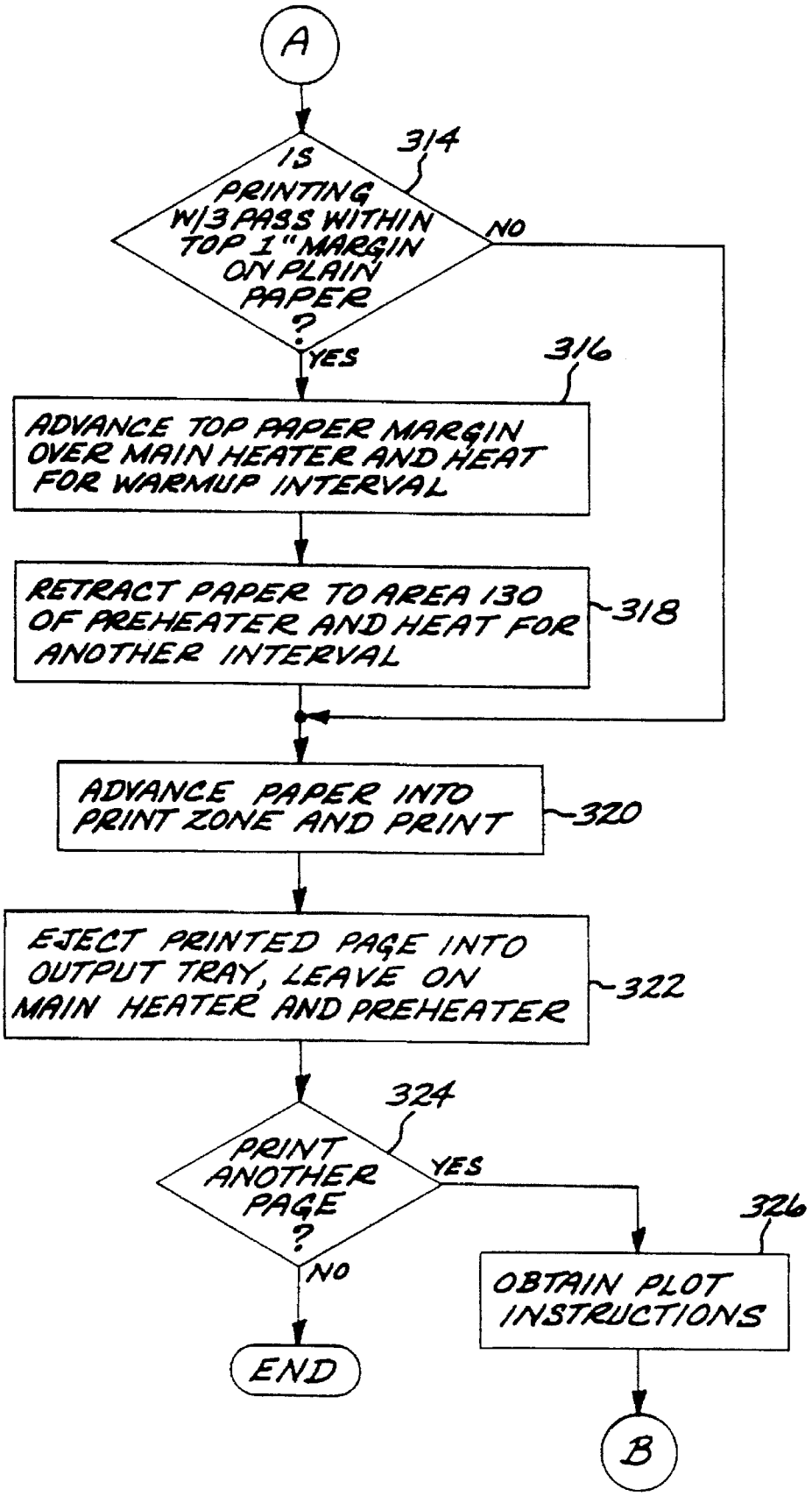

FIGS. 20A and 20B set forth a simplified flow diagram of the operation of the paper path and media handling systems comprising the printer 50. At step 300, plot instructions are received by the printer controller 200, typically from the host computer 210. In the case in which the printer has just been powered up, or in the event of a long time delay since the last print job executed by the printer, the controller 200 initiates a warm up procedure (step 302) to warm up the main heater 108 at a high power level for a warmup interval, e.g., 26 seconds in this embodiment. Upon expiration of the warmup interval, the main heater is turned off (step 304), and the sheet feed operation is commenced by actuating the pick roller 290 and turning on the preheater 72. A sensor 63 located on the carriage 61 acts as a leading edge sensor to detect the presence of the leading edge of the sheet at the print area. Once the leading edge has reached the print zone, the main heater is turned on at the proper power level for the type of medium loaded into the printer (step 312). Plain paper will withstand higher temperatures than transparent polyester-based media, for example, as described more fully in co-pending application Ser. No. 07/876,924.

Referring now to FIG. 20B, step 314 bypasses steps 316 and 318 under certain circumstances. Steps 314 and 318 are only carried out if printing for the particular swath to be performed by the printer is to be performed within the top one inch margin of the sheet using a three pass print mode. In such a three pass print mode, three passes of the cartridge are required to complete printing the swatch. This print mode is useful to print very high quality text or graphics, with reduced paper cockle and bleed effects, as described more fully in the above-referenced pending application, Ser.

No. 07/876,924. In such case, since there may be a relatively cold band of paper at the top margin due to the shielding between "B" and "C" (FIG. 7) from the screen edge, which would have a deleterious effect on print quality at that band. To eliminate this problem, steps 316 and 318 are performed. The top paper margin is advanced over the main heater 108 at the print area, and remains there for a warmup interval, e.g., 7 seconds. Then, at step 318, the sheet is retracted to adjacent area 130 of the preheater 72, to warm up the relatively cold band for another interval, e.g., 6 seconds. At step 320, the sheet is advanced into the print zone, and printing operations proceed. After printing is completed, the sheet is ejected into the output tray, and the main heater and preheater are left "on" for one minute (step 322). If another page is to be printed (step 324), the plot instructions for that page are obtained from the host computer (step 326), and operation branches to step 306. If no further pages are to be printed within one minute, the power in the main heater 108 is set to the idle state, the preheater 72 is turned off, and present operations are completed.

Figure 21:
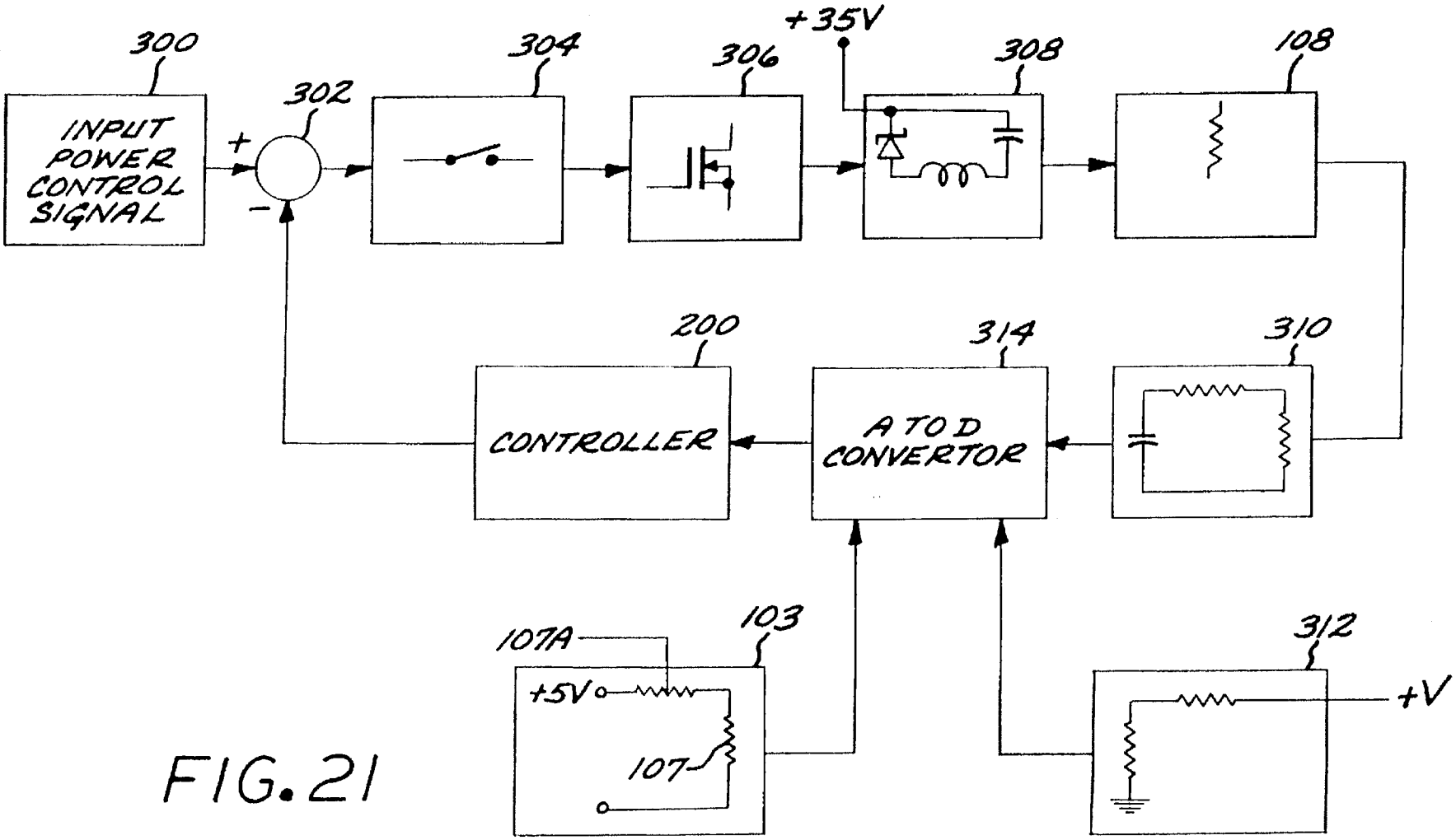
FIG. 21 is a block diagram illustrating the heater control circuit.

FIG. 21 is a block diagram of aspects of the heater drive circuit 206. The control and processing functions are carried out by the controller 200 in this embodiment. The heater element 108 is controlled by a pulse width modulating, variable frequency, constant power control system 206. The host computer 210 or printer media select switches 208 determine which media heater power setting is required, i.e., a 28 watt power setting is used for glossy media, a 63 watt power setting is used for transparencies, and a 73 watt power setting is used for paper, a control signals indicative of the required nominal power setting are selected by the controller 200. These nominal power setting control signals are passed to a subtraction node 302, actually a function carried out by the controller 200 in the preferred embodiment, where the error signal developed by the feedback control loop is subtracted. The node output is the corrected control signal which is passed to the heater drive element 306 if the interlock switch 304 is closed. The switch 304 is opened when the printer housing cover 62 is opened, and closed when the cover is closed. The purpose of the interlock switch is to interrupt power to the heater when the cover is open, to reduce the possibility of injury to the printer operator. If the switch is closed, the corrected control signals control the heater driver level converter element, an N channel MOSFET 306 in this embodiment, to produce the pulse width modulated heater drive signal. The heater drive signal is passed through a low pass filter 308 to prevent the heater element from oscillating, changing the 35 V pulse width modulated, 3 ampere switch current to an average DC signal passed to the heater element 108. The current drawn through the heater element 108 is sensed by a current sense circuit 310, and the voltage across the element 108 is sensed by a voltage sense circuit 312. The sensed current and voltage levels are converted to digital signals by analog-to-digital convertor 314, and the resulting digitized signals are passed to the controller 200. The controller multiplies the average current and heater voltage to calculate average power. The controller 200 adjusts the pulse width to maintain constant power.

The controller 200 also receives the temperature sensing signal from a temperature sensing circuit 103, comprising a thermistor 107 and 3.8 Kohm resistor connected in series to a +5 V supply level to form a voltage divider circuit. The thermistor is placed on a heater printer circuit board adjacent a hole in the heater reflector. The thermistor in this exemplary embodiment has a resistance of 1000 ohms at 100 degrees C., and has a 0.62% per degree C. temperature coefficient. The controller 200 reads the thermistor via the analog-to-digital converter 314, and determines the heater element temperature state. With this information, the controller determines the 110 watts overdrive power time (for paper or transparency) or cool down time (for glossy) for the heater element.

Having determined the heater temperature, and if the media is transparency or paper, the controller 200 will overdrive the element 108 to 110 watts, as measured by the current and voltage sensing circuits. The controller adjusts the heater element every 5 seconds while the heater element is at 110 watts. The heater element remains at 110 watts for a minimum of 26 seconds in this embodiment, or for the time determined by the thermistor 107 state. The overdrive of the heater element 108 will stop if the temperature is indicated at over 85 degrees C. for paper or 80 degrees C. for transparency. This is to prevent the heater element from overheating. After the 110 watt warm-up phase, the heater element power is set to the media printing power for the selected media type, i.e., 73 watts for paper and 63 watts for transparency. The actual printing power is recalculated once per page. If the medium is glossy and the heater element 108 previous state was the idle state (20 watts), the controller will set the heater element 108 power setting to 28 watts. If the heater element has previously been in a higher power state (63 watts for transparency, or 73 watts for paper), the controller 200 will turn the heater element off (0 watts) and monitor the thermistor every 5 seconds for up to a minute. Once the heater element has cooled, the controller will set the heater element power setting to 28 watts. The controller recalculates the heater element power once per page. If the printer has no print jobs for one minute, the controller set the heater element power level to 20 watts, the idle state.

Figure 22A:
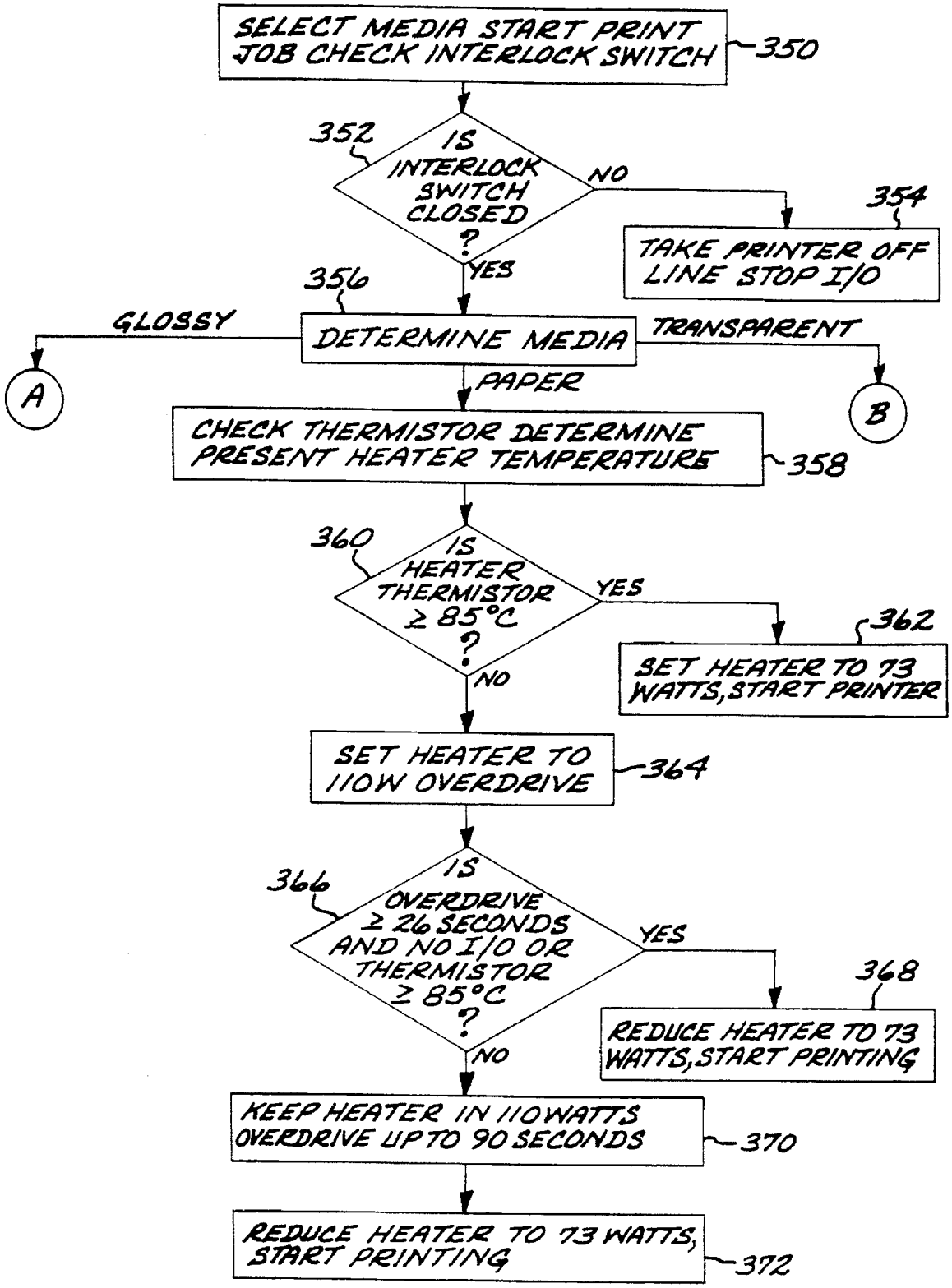
FIGS. 22A–22C are flow diagrams illustrating the operation of the print heater of the printer of FIG. 1.
Figure 22B:
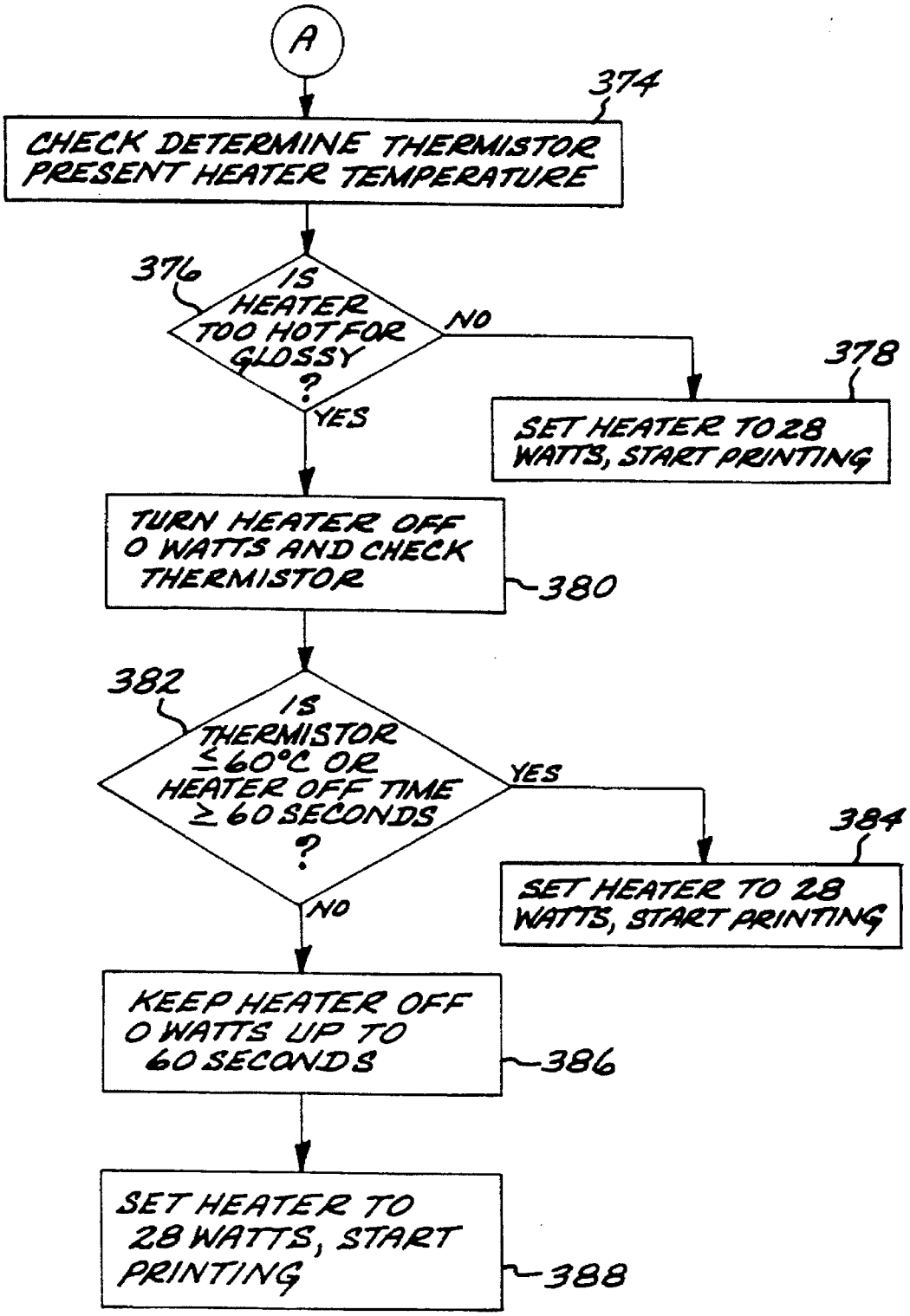
Figure 22C:
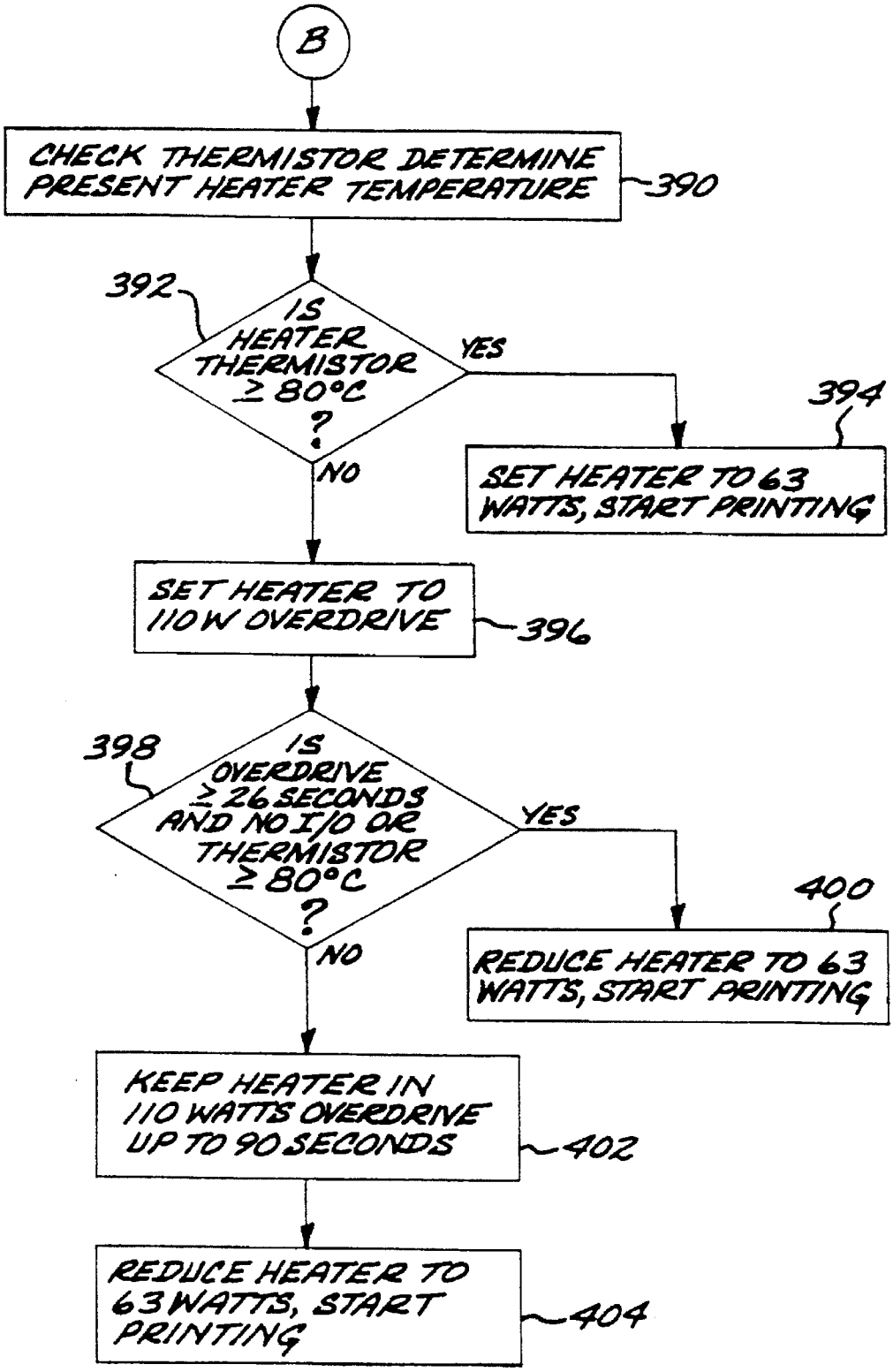

The control of the heater 108 is shown in further detail in FIGS. 22A–22C. At step 350, the media type is specified, either by the host computer or the printer switches 208, the print job is started, and the interlock switch 304 is checked. If it is not closed, the printer is taken off-line, and input/output operations are stopped. If the switch is closed, operation branches to A if the C media type is glossy, to B if transparency, or to step 358 if paper. At 358, the thermistor reading is checked, and the present heater temperature is determined. If the calculated temperature equals or exceeds 85 degrees C. (step 360), the heater is set to 73 watts nominal power, and the printer starts printing operations. If the heater is not at 85 degrees C., the heater drive is set to the 110 watt overdrive state (step 364), for either a 26 second overdrive interval in the absence of printer input/output (I/O) or until the temperature equals or exceeds 85 degrees C. The heater element can be overdriven a maximum of 90 seconds. The heater power is then reduced to 73 watts, and printing operations begin (step 368 or 372).

Node A is shown in FIG. 22B, showing the operation for glossy media. The heater temperature is determined at step 374 using the thermistor 107. If the heater 107 is not too hot for glossy media (step 376), the heater 107 nominal power control is set to 28 watts, and printing operations are commenced. If the heater element is too hot, the heater element 108 is turned off (step 380), and the thermistor is read again. If the thermistor reading indicates a heater temperature of 60 degrees C. or less, or if the heater off time equals or exceeds 60 seconds (step 382) the heater is set to 28 watts, and printing operations commence (step 384). Otherwise, the heater is kept off for up to 60 seconds (step 386), and printing operations are commenced.

FIG. 22C illustrates the heater operation for transparency media. At step 390, the heater temperature is determined. If the temperature equals or exceeds 80 degrees C., the heater is set to 63 watts, and printing commences. If the temperature is below this threshold, the heater is set to the overdrive 110 watt condition (step 396). Once the heater has been in this mode for 26 seconds with no print I/O or until the temperature exceeds 80 degrees C., the heater power will be reduced to 63 watts, and printing commences (steps 398, 400). The heater will be operated in this overdrive condition for up to 90 seconds, or until the temperature equals or exceeds 80 degrees C. (step 402), at which time the heater power level is reduced to 63 watts, and printing commences.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An ink-jet printer for printing onto a print medium, comprising:

a printhead for printing onto a printing medium, said printhead comprising means for ejecting droplets of ink onto a first surface of said medium at a print area in a controlled fashion;

means for advancing the print medium via a medium path to said print area during operations; and a stationary preheater disposed along said medium path for preheating said medium before said medium reaches said print area to precondition said medium for printing operations, said stationary preheater comprising:

a flexible heating member defining a flexible heater surface, said member including flexible means for heating said heating surface; and means for supporting said flexible heating member in a fixed, non-movable position along said medium path so that said surface presents a curved surface which is directly contacted by said medium as said medium is advanced along said medium path to said print area, said curved surface defining a portion of said medium path, and said medium is heated by direct contact with said curved heating surface.

2. The printer of claim 1 wherein said heating member comprises a flexible electrical conductors layer and a pattern of flexible electrical conductors carried by said layer, and said preheater further comprises means for energizing said heating means by passing electrical current through said flexible electrical conductors.

3. The printer of claim 2 wherein said first energizing means comprises a DC power source.

4. The printer of claim 2 wherein said a first set of said conductors are disposed within a first area of said heating surface to heat said surface at a first rate, and a second set of said conductors is disposed within a second area of said heating surface to heat said surface at a second rate.

5. The printer of claim 4 wherein said first rate is a higher heating rate than said second rate, and wherein said first area is disposed adjacent said printer zone, such that said medium first encounters said second heating area, and subsequently encounters said first heating area immediately prior to encountering said printer area.

6. The printer of claim 1 wherein said printer further comprises an input media tray for holding a input supply of media in sheet form, and an output media tray for receiving said medium sheet of media after completion of said printing operations on said medium sheet, wherein said input and output trays are disposed on the same side of the printer, to facilitate access by a printer operator, and said paper path includes a direction reversal to allow paper to be fed in a first direction from said input tray into said paper path, and to be ejected in a second direction from said print area into said output tray, said second direction substantially opposite to said first direction.

7. The printer of claim 6 wherein said paper path defines a curved portion to enable said direction reversal, and wherein said curved surface of said member serves to define a portion of said paper path.

8. An ink-jet printer for printing onto a print medium, comprising:

a printhead for printing onto a printing medium, said printhead comprising means for ejecting droplets of ink onto a first surface of said medium at a print area in a controlled fashion;

means for advancing the print medium via a medium path to said print area during print operations; and a stationary preheater disposed along said medium path for preheating said medium before said medium reaches said print area to precondition said medium for printing operations, said stationary preheater comprising:

a flexible heating member defining a heating surface;

means for heating said heating surface; and means for supporting said heating member in a fixed, non-movable position along said medium path so that said surface presents a curved surface which is directly contacted by said medium as said medium is advanced along said medium path to said print area, and said medium is heated by direct contact with said curved heating surface, said means for supporting said flexible heating member comprising means for supporting first and second opposed edges of said member along first and second curved paths, said first and second edges being parallel to the direction of advancement of said medium.

9. The printer of claim 8 wherein said means for supporting said flexible heating member further comprises means for fixing a third edge of said heating member in a direction generally orthogonal to said direction of medium advancement, and means for biasing a portion of a fourth edge of said heating member so as to hold said flexible heating member taut along said first and second curved paths.

10. An ink-jet printer for printing onto a print medium, comprising:

a printhead for printing onto a printing medium, said printhead comprising means for ejecting droplets of ink onto a first surface of said medium at a print area in a controlled fashion;

means for advancing the print medium via a medium path to said print area during print operations; and a stationary preheater disposed along said medium path for preheating said medium before said medium reaches said print area to precondition said medium for printing operations, said stationary preheater comprising:

a flexible heating member defining a heating surface, said flexible heating member comprising an area of a thin film suspended in air by said supporting means, said heating surface characterized by a low thermal mass, thereby minimizing the time required to warm said surface to a desired warmup time;

means for heating surface; and means for supporting said heating member in a fixed, non-movable position along said medium path so that said surface presents a curved surface which is directly contacted by said medium path to said print area, and said medium is heated by direct contact with said curved heating surface.

11. The printer of claim 10 further comprising a printer controller for controlling the operation of said preheater via application of electrical power, said controller acting to apply power to said preheater only during active printing operations when a medium is loaded into said paper path.

12. The printer of claim 11 wherein said printer controller further comprises means for receiving printing instructions to print onto a print medium, means for activating said medium advancing means and means for energizing said preheater to preheat said medium upon activation of said advancing means.

13. The printer of claim 12 wherein said printing instructions comprise data defining a type of print medium to be advanced to the print area for print operations, and said type is selected from a media type group including plain paper and polyester-based media, and wherein said controller comprises means responsive to said print medium type data to energize said preheater only if said instructions indicate that said medium type is plain paper.

14. A method of color printing by applying liquid ink to a print medium, comprising the following steps:

advancing the print medium via a medium path to a print area during printing operations;

disposing a stationary preheater along said medium path for preheating said medium before said medium reaches a print area, said preheater including a flexible heating member defining a heating surface, said heating member including flexible means for heating said heating surface, and means for supporting said heating member in a fixed, non-movable position along said medium path so that said surface presents a curved surface which defines a portion of said medium path and is directly contacted by said medium as said medium is advanced along said medium path to said print area;

passing said medium past said preheater surface to preheat said medium by direct contact with said heating surface; and applying liquid ink to said medium at said print area.

15. The method of claim 14 wherein said heating member further includes a flexible film dielectric layer and a pattern of flexible electrical conductors carried by said layer, and said heating means further comprises means for energizing said preheating means by passing electrical current through said flexible electrical conductors.

16. The method of claim 14 further including the steps of heating a first area of said heated surface at a first heating rate, and heating a second area of said heated surface at a second rate, said first rate being higher than said first rate.

17. The method of claim 16 wherein said medium encounters first said second area and then said second area as it is being advanced along said medium path to said printing area.

18. The method of claim 17 wherein said first area is disposed adjacent said printer zone, such that said medium first encounters said second heating area, and subsequently encounters said first heating area immediately prior to encountering said print area.

19. The method of claim 14 further comprising the step of controlling the operation of said preheating means to apply power to said preheating means only during active printing operations when a medium is loaded into said paper path.

20. The method of claim 19 further comprising the step of receiving printing instructions comprising data defining a type of print medium to be advanced to the print area for print operations, and said type is selected from a media type group including plain paper and polyester-based media, and wherein said preheating means is energized only if said instructions indicate that said medium type is plain paper.

21. The method of claim 14 wherein said medium path defines a curved portion to enable a medium path direction reversal, and wherein said curved surface of said preheating means serves to define a portion of said curved portion of said path.

22. A method of color printing by applying liquid ink to a print medium, comprising the following steps:

advancing the print medium via a medium path to a print area during printing operations;

disposing a stationary preheater along said medium path for preheating said medium before said medium reaches a print area, said preheater including a flexible heating member defining a heating surface, said flexible heating member including an area of a thin film suspended in air by said supporting means, said heating surface is characterized by a low thermal mass, thereby minimizing the time required to warm said heating surface to a desired warmup time, means for heating said heating surface, and means for supporting said heating member in a fixed, non-movable position along said medium path so that said surface presents a curved surface which is directly contacted by said medium as said medium is advanced along said medium path to said print area;

passing said medium past said preheater surface to preheat said medium by direct contact with said heating surface; and applying liquid ink to said medium at said print area.

* * * * *